US009622933B2

(12) United States Patent
Sackner et al.

(10) Patent No.: US 9,622,933 B2
(45) Date of Patent: Apr. 18, 2017

(54) PASSIVE SIMULATED JOGGING DEVICE

(71) Applicants: Marvin Sackner, Miami, FL (US); Jose Antonio Adams, Miami, FL (US)

(72) Inventors: Marvin Sackner, Miami, FL (US); Jose Antonio Adams, Miami, FL (US)

( * ) Notice: Subject to any disclaimer, the term of this patent is extended or adjusted under 35 U.S.C. 154(b) by 0 days.

(21) Appl. No.: 14/895,417

(22) PCT Filed: Jun. 2, 2014

(86) PCT No.: PCT/US2014/040534
§ 371 (c)(1),
(2) Date: Dec. 2, 2015

(87) PCT Pub. No.: WO2014/197385
PCT Pub. Date: Dec. 11, 2014

(65) Prior Publication Data

US 2016/0128889 A1 May 12, 2016

Related U.S. Application Data

(60) Provisional application No. 61/830,448, filed on Jun. 3, 2013.

(51) Int. Cl.
*A61H 1/02* (2006.01)
*A61H 1/00* (2006.01)
*A61H 23/00* (2006.01)

(52) U.S. Cl.
CPC ..... *A61H 1/0266* (2013.01); *A61H 1/005* (2013.01); *A61H 23/006* (2013.01); *A61H 1/006* (2013.01);
(Continued)

(58) Field of Classification Search
CPC .... A61H 23/006; A61H 1/0266; A61H 1/005; A61H 2201/1676; A61H 2201/1418;
(Continued)

(56) References Cited

U.S. PATENT DOCUMENTS 3,318,304 A 5/1967 Gurewich
4,842,265 A * 6/1989 Kirk ..... A61H 1/0266 601/31

(Continued)

FOREIGN PATENT DOCUMENTS

| | | |
|---|---|---|
| CN | 1662204 | 8/2005 |
| DE | 102005014204 | 10/2006 |
| WO | WO 90/01312 | 2/1990 |

OTHER PUBLICATIONS

Santhanam et al. "Activation of endothelial nitric oxide synthase is critical for erythropoietin-induced mobilization of progenitor cells." Peptides, Aug. 2008 29(8):1451-1455.*

(Continued)

*Primary Examiner* — Justine Yu
*Assistant Examiner* — Douglas Sul
(74) *Attorney, Agent, or Firm* — Cozen O'Connor

(57) ABSTRACT

A motorized machine for passively applying a tapping force to the bottoms of a user's feet includes a motor, a pedal rocking mechanism, at least one pedal and at least one bumper configured so as to cooperate to, during operation of the motor, cause the bottom portion of the at least one pedal to tap against the at least one bumper so as to provide pulsatile acceleration to the bottom of the user's foot. The pulsatile acceleration has a force sufficient to increase pulsatile shear stress to the endothelium, of sufficient magnitude to cause the release of beneficial mediators.

22 Claims, 12 Drawing Sheets

(52) U.S. Cl.
CPC ..... *A61H 2201/0126* (2013.01); *A61H 2201/1215* (2013.01); *A61H 2201/1418* (2013.01); *A61H 2201/164* (2013.01); *A61H 2201/1676* (2013.01); *A61H 2203/0406* (2013.01); *A61H 2203/0456* (2013.01)

(58) Field of Classification Search
CPC ..... A61H 2201/164; A61H 2201/1215; A61H 2201/0126; A61H 2203/0456; A61H 2203/0406; A61H 23/008; A61H 2201/018; A63B 22/0048; A63B 22/0056; A63B 22/0058; A63B 2022/0097; A63B 23/0429
See application file for complete search history.

(56) References Cited

U.S. PATENT DOCUMENTS 4,862,875 A * 9/1989 Heaton ..... A61H 1/0266 482/79
5,046,484 A * 9/1991 Bassett ..... A61H 1/006 482/146
6,155,976 A 12/2000 Sackner et al.
6,572,514 B1 * 6/2003 Calafato ..... A63B 22/0056 482/79
7,211,054 B1 5/2007 Francis
7,228,576 B2 6/2007 Inman et al.
2002/0103454 A1 * 8/2002 Sackner ..... A61H 1/001 604/19
2002/0183663 A1 * 12/2002 Lu ..... A61H 1/003 601/28
2004/0053753 A1 * 3/2004 Galvez Campos .. A61H 1/0255 482/70
2008/0139979 A1 * 6/2008 Talish ..... A61H 1/001 601/51
2010/0121410 A1 5/2010 de Larreta-Azelain Oliveras et al.
2011/0256983 A1 * 10/2011 Malack ..... A61H 1/0266 482/4

OTHER PUBLICATIONS

International Preliminary Report on Patentability and Written Opinion dated Dec. 8, 2015 which issued in the International Patent Application No. PCT/US2014/040534.

* cited by examiner

DESCENT OF DICROTIC NOTCH AS A REFLECTION OF NITRIC OXIDE RELEASE INTO CIRCULATION

PASSIVE SIMULATED JOGGING DEVICE

PRIORITY CLAIM

This is a U.S. national stage of application No. PCT/US2014/040534, filed on Jun. 2, 2014. Priority is claimed on UNITED STATES, Application No. 61/830,448, filed Jun. 3, 2013, the content of which is incorporated herein by reference.

FIELD OF THE INVENTION

The present invention relates to a portable, electrically powered machine for passive upward lifting and downward tapping of the feet in seated or supine humans.

BACKGROUND OF THE INVENTION

In contemporary society, prolonged sitting has been incorporated into our lives across many settings, including transportation, the workplace, and the home. New evidence indicates that too much sitting (also known as sedentary behavior—which involves very low energy expenditure, such as television viewing and desk-bound work) is adversely associated with health outcomes, including cardio-metabolic risk biomarkers, type 2 diabetes and premature mortality. Importantly, these detrimental associations remain even after accounting for time spent in leisure time physical activity. Epidemiological and experimental studies make a persuasive case that too much sitting should now be considered an important stand-alone component of the physical activity and health equation, particularly in relation to diabetes and cardiovascular risk.

Such risk might be confounded by eating precooked/canned food and snacks, because it is known that this type of food is frequently consumed while watching TV. In fact, there is evidence that it is the type and amount of food consumed while viewing TV that is responsible for the association between TV viewing and excess weight that are associated with low physical activity. Snacking has been associated with an additional 1.5 h/week of TV viewing compared with not snacking in adults. Snacking is associated with poorer diet quality as linked to a higher intake of total energy, total fat, animal and vegetable fat and to a greater consumption of fast-foods, sweets, and sugar-sweetened beverages. The mechanisms of some of the observed associations are easy to guess. For instance, eating while watching TV or eating while seated on a sofa or an armchair could naturally be associated with more time watching TV. This is also the case for eating precooked/canned food and snacks, because it is known that this type of food is frequently consumed while watching TV. In fact, there is evidence that it is the type and amount of food consumed while viewing TV that is responsible for the association between TV viewing and excess weight.

Most US residents lead sedentary lives and do not get enough physical activity. In the USA, less than 5% of adults and only 8% of adolescents (aged 12-19 years) adhere to the recommendation for 30 and 60 min, respectively, of daily physical activity. The amount of time spent doing sedentary activities, like sitting at a computer or watching TV, has also increased dramatically. Now, 8-18-year olds in the USA devote an average of 7 h and 38 min to using entertainment media across a typical day, which translates to 53 h a week.

Higher amounts of overall sitting time and television viewing are positively associated with mortality. In the NIH-AARP Diet and Health Study, 240,819 adults (aged 50-71 y) who did not report any cancer, cardiovascular disease, or respiratory disease at baseline were examined. Mortality was ascertained over 8.5 y. Sedentary behaviors were positively associated with mortality after adjustment for age, sex, education, smoking, diet, race, and moderately vigorous physical activity (MVPA).

Sitting is unhealthy. Both longer lengths and fewer breaks from sitting time increase metabolic risk and transitioning to a greater sedentary time for one day reduced insulin sensitivity significantly. Reduction in daily ambulatory activity increased insulin response to an oral glucose tolerance test and visceral fat mass at 1 and 2 weeks, respectively.

The natural history of diabetes type 2 (T2D) is associated with progressive deterioration in insulin sensitivity (insulin resistance) that is initially compensated for by an increase in insulin secretion (hyperinsulinemia) to maintain glycemic control. However, with time, β-cell function in the pancreas deteriorates and insulin is no longer secreted in appropriate amounts to compensate for low insulin sensitivity leading to glucose intolerance, hyperglycemia and the subsequent diagnosis of T2D. Diabetes is associated with fatty liver disease, cognitive decline and some cancers, and, end-stage complications include blindness, renal failure, amputation and cardiovascular disease. Persons with T2D have approximately a twofold increased mortality rate and the associated costs put a huge economic burden on health care systems. In the U.S., one-third of adults and 16-18% of youth are obese, up from 5 to 6% three decades ago. Increases in rates of type 2 diabetes have closely tracked increases in obesity. In the U.S., diabetes affects 8.3% of the population that includes 18.8 million with diagnosed diabetes and another 7 million undiagnosed. An additional 35% of U.S. adults or 79 million Americans aged equal or greater than 20 years have pre-diabetes and about one in three American adults will have diabetes by the year 2050.

The diabetes epidemic has become global. An estimated 500 million people worldwide are obese and another 1.5 billion are overweight. About 3 million people die each year due to overweight and obesity. In 2011, 366 million people worldwide had diabetes and it caused 4.6 million deaths. The International Diabetes Federation estimates that by 2030, the number of individuals with diabetes will rise by almost 43% to 552 million. In 2011, about 280 million people had pre-diabetes; by 2030 this number is expected to rise to nearly 400 million. Therefore, determining effective prevention and treatment strategies are essential.

The clinical significance of inactivity-induced decrease in insulin sensitivity is that the presence of decreased insulin sensitivity is necessary to develop pre-diabetes, in turn a precursor to T2D. Individuals with T2D have shorter average life span. Not surprisingly, lifetime physical inactivity is associated with increased T2D prevalence and mortality. Furthermore, glucose metabolism becomes dysfunctional prior to changes in body fat content and/or VO2max suggesting that this malady likely is inactivity-induced rather than whole body adiposity induced.

Accumulating evidence suggests that obtaining the recommended volume of exercise per week does not necessarily protect an individual from disease. For example, office workers who achieve 150 min of defined exercise per week but remain grossly sedentary in every other facet of their life, including sitting for >8 h/day, have an elevated risk of all-cause mortality. Unfortunately, the average adult spends 50-60% of their day in sedentary pursuits defined as sitting or lying and less than 3% of US adults obtain the suggested levels of weekly physical activity. So in most cases individuals are both sedentary and inactive. But, moving beyond these important classifications, what is the current evidence to support that 'type 2 diabetes sits in a chair'? Adolescents with T2D spent 56 more minutes per day being sedentary than their age-matched non-diabetic controls. Sitting time was also inversely associated with glycaemia even when correcting for physical activity. Television watching time can be used as a strong surrogate of sitting or sedentary time. Television watching time >40 vs. <1 h a week increases the risk of developing T2D by 50-70%. The link between television watching time (a surrogate of sitting time) and risk of T2D is not substantially altered when correcting for daily physical activity. Even if an individual has increased physical activity levels they are still at risk if sedentary behavior is not corrected. In adults at high risk of T2D, time spent sedentary is strongly and adversely associated with 2-h OGTT glucose levels.7

Besides the work place, commuting must be considered as part of the day in which sitting time occurs. The 2009 US Census Bureau reported that of 132 million people surveyed, only 3.8 million people commuted to work using non-vehicular means of transport (walking and cycling). Thus 97% of the US population sits in a vehicle to and from the workplace every day. Since the average commute time is 25.1 min, the average US citizen spends approximately 50 min/day sitting in a vehicle to get to and from work. If active travel such as walking or cycling the entire distance is not feasible, to easily reduce this sitting time one may park their car or dismount the bus/train further from work and walk the remaining distance. Alternatively, one might choose to stand rather than sit on their bus/train journey to the workplace. But compliance on this issue is difficult to attain.

Epidemiologic investigations into the health effects of a "sedentary lifestyle" has customarily focused on the adverse effects associated with a lack of participation in recommended levels of exercise, or moderate-vigorous physical activity (MVPA). Understanding of the potential adverse effects of time spent in sedentary behaviors on overall physical activity levels is evolving rapidly as the role of daily activities and non-exercise energy expenditure in health is better defined. Time spent in sedentary behaviors reflects a wide range of human pursuits that involve sitting or reclining and only low levels of energy expenditure. The average US adult spends more than half of his or her waking day in sedentary behaviors, and older adults spend upward of 60%, or 9 h, of their time each day in sedentary behaviors. Higher amounts of sedentary time are independently associated with increased risk of weight gain and obesity, poor metabolic health, and mortality. Sitting during leisure time was positively associated with mortality even after overall physical activity levels were controlled for, and that high levels of total activity did not minimize risk related to sitting. Similar findings on the independent and combined effects of activity and overall sitting time and television viewing have been found.

The estimated gains of life expectancy in the U.S. population are 2 years for reducing excessive sitting to <3 hours per day and a gain of 1.4 years for reducing excessive television viewing to 2 hours per day. van der Ploeg H P, Chey T, Korda R J et al., "Sitting time and all-cause mortality risk in 222 497 Australian adults," Arch Intern Med 2012; 172(6):494-500, linked prospective questionnaire data from 222 497 individuals 45 years or older from the 45 and Up Study to mortality data from the New South Wales Registry of Births, Deaths, and Marriages (Australia) from Feb. 1, 2006, through Dec. 31, 2010. In 621 695 person-years follow-up with a mean of 2.8 years), 5405 deaths occurred. All-cause mortality hazard ratios were 1.02 (95% CI, 0.95-1.09), 1.15 (1.06-1.25), and 1.40 (1.27-1.55) for 4 to less than 8, 8 to less than 11, and 11 or more hours per day of sitting, respectively, compared with less than 4 h/d, adjusting for physical activity and other confounders.

The population-attributable fraction for sitting was 6.9%. The association between sitting and all-cause mortality appeared consistent across the sexes, age groups, body mass index categories, and physical activity levels and across healthy participants compared with participants with preexisting cardiovascular disease or diabetes mellitus. Therefore, prolonged sitting is a risk factor for all-cause mortality, independent of physical activity.

In individuals older than 60 years, every additional hour a day spent sitting is linked to a 50 percent greater risk of being disabled—regardless of how much participation in moderate exercise. Thus, sedentary behavior is its own risk factor for disability, separate from lack of moderate vigorous physical activity. Sedentary behavior is almost as strong a risk factor for disability as lack of moderate exercise. Disability that affects more than 56 million Americans is the inability to carry out daily activities of living such as eating, dressing or bathing oneself, getting in and out of bed and walking across a room. Disability increases the risk of hospitalization and institutionalization and is a leading source of health care costs, accounting for $1 in $4 spent.

It has been recommended that one should achieve 10,000 steps per day as measured with a pedometer or accelerometer which represents 30 min of moderate-to-vigorous physical activity (MVPA) added to a minimum level of baseline physical activity. Thirty minutes of moderate activity translates to 3,000-4,000 steps at a stepping rate of 100 steps per minute. Adding this amount to the questionable assumption of 6,000-7,000 steps from routine activities of daily living approximates 10,000 steps per day. However, a recent study, Scheers T, Philippaerts R, Lefevre J. "Compliance with different physical activity recommendations and its association with socio-demographic characteristics using an objective measure," BMC Public Health 2013; 13:136, revealed that only 16% men and 14% of women reached at least 10,000 steps per day on seven consecutive days. When the frequency requirement was decreased to 5 days/week, 45% of men and 55% of women achieved this goal.

In a study of sedentary office workers monitored with a pedometer for step counts had significantly higher levels of sedentary behavior on work days (517±144 min/day) compared with non-work days (339±137 min/day). Overall, 65% of time at work was sedentary, and sitting at work accounted for 63% of total daily sitting time. Those who were most sedentary at work did not compensate by reducing their sedentary behavior outside work. In fact, those who reported sitting for longest at work reported sitting for longer outside work. The conclusion of this study was that occupational health interventions should aim to reduce workplace and leisure-time sitting in sedentary office workers.

This background of the health hazards of excessive sitting clearly indicates need for an intervention to counteract its ill effects. In an advanced society, recommendations for alterations in life style such as intermittently changing posture to standing have been poorly accepted. The basis for the adverse effects of prolonged sitting must be understood in order to arrive at a solution. Since the major mortality outcomes of prolonged sitting relate to development of cardiovascular disease and diabetes, one must look to the commonality between these two diseases and their pathophysiologic basis. This lies in observations that a sedentary life style leads to 1) reduced energy expenditure with the potential development of obesity that is compounded by obesity-related eating behaviors and 2) endothelial dysfunction that is the basis in whole or in part for most chronic "sitting" diseases.

A recent attempt to provide a solution for too much sitting has been to incorporate a "treadmill desk" into the office or home. An internet site: http://www.workwhilewalking.com/how-many-treadmill-desks-are-in-use-today estimated that from 300,000 to 500,000 were either purchased or constructed in the United States as of the fourth quarter 2013. The average price for this equipment is $2,400 which also requires an accompanying desk for sitting and a large amount of floor space and non-portability.

The speed for walking on a treadmill while working at a computer is less than 2 miles per hour. To prevent injury, treadmill desks require compliance with the same ergonomic safety standards recommended for any computer desk, including placement such that the user's wrists are flat by the keyboard, their elbows form a 90-degree angle when typing, and their eyes may look forward to the monitor. Users who tested treadmill desks reported advice to retain a traditional desk with a seat and to alternate between sitting and walking at different desks while becoming accustomed to the treadmill desk. Additionally, reading email and surfing the Internet were found to be easier to manage than learning to type or write while standing and walking which is a multitasking procedure. Talking on the phone while walking can be disruptive in some cases either because of changing the breathing rate of the user or because of the noise from the treadmill itself.

A treadmill desk is not intended to provide aerobic exercise but to set the user's metabolism over the basal metabolic rate, e.g. to increase non-exercise activity thermogenesis (NEAT). In this respect, treadmill desks do not address the other major problem of excessive sitting, the development of endothelial dysfunction.

While the health advantages of sitting less are well established, helping to cut the risk of obesity and heart disease, the productivity benefits of so-called active workstations are less clear from the results of the small studies to date. A 2011 Mayo Clinic study of 11 medical transcriptionists found that typing speed and accuracy slowed by 16% while walking on a treadmill desk compared with sitting. And a 2009 study from the University of Tennessee, with 20 participants, found that treadmill walking resulted in an up to 11% deterioration in fine motor skills like mouse clicking, and dragging and dropping, as well in as cognitive functions like math-problem. Thus, the treadmill desk offers a way to reduce sedentariness in the workplace and has potential to reduce employee obesity and health care costs. However, more than 4 hours of training will be necessary to prevent a significant drop in employee productivity.

Endothelial dysfunction occurs when cells lining the inner wall of blood vessels exposed to flowing blood 1) fail to release beneficial mediators into the circulation, 2) release diminished amounts of beneficial mediators into the circulation, and/or 3) release deleterious substances into the circulation. The underlying basis for endothelial dysfunction is reduced shear stress to the inner lining of blood vessels (endothelium) from blood flowing slowly or oscillating to and fro over it.

Endothelial dysfunction is caused by chronic exposure to various stressors such as oxidative stress and inflammation resulting in impaired endothelial nitric oxide bioavailability. Biomechanical forces on the endothelium, including low and oscillatory shear stress associated with hypertension and arteriosclerosis are also important causes of endothelial dysfunction. Smoking increases oxidative stress and is a major risk to endothelial dysfunction. In patients with diabetes, insulin resistance and signaling is impaired. Increased vascular inflammation, including enhanced expression of interleukin-6 (IL-6), vascular cellular adhesion molecule-1 (VCAM-1) and monocyte chemoattractant protein (MCP-1) are observed, as is a marked decrease in NO bioavailability. Furthermore, hyperglycemia leads to increased formation of advanced glycation end products (AGE) that quench NO and impair endothelial function. Patients with diabetes invariably show an impairment of endothelium-dependent vasodilation, a marker of endothelium dysfunction. Therefore, understanding and treating endothelial dysfunction is a major focus in the prevention of vascular complications associated with all forms of diabetes mellitus.

Because the hallmark of endothelial dysfunction is reduced bioavailability of nitric oxide, oral administration of L-arginine, the substrate for generation of NO by endothelial nitric oxide, have been attempted but met with failure. Oral administration of L-arginine is met with increasing levels of arginase that produce deleterious free oxygen radicals. Increased activity of arginase in endothelial dysfunction due to low or oscillatory shear stress is present in hypertension, pulmonary arterial hypertension, atherosclerosis, myocardial ischemia, congestive heart failure, and diabetes mellitus. Elevated levels of arginases cause eNOS uncoupling in that eNOS reaction with L-arginine produces superoxide instead of nitric oxide which results in vascular oxidative stress and inflammatory responses. Increased laminar and pulsatile shear stress to the endothelium during exercise or WBPA inhibits release of arginases thereby improving endothelial dysfunction.

Normal or elevated shear stress mechanically stimulates the endothelial cells to increase the activity of genes responsible for release of beneficial mediators, the most important one of which is nitric oxide. Its discovery led to a Nobel Prize in Medicine for Robert F. Furchgott, Louis J. Ignarro, and Ferid Murad in 1998. Two processes increase shear stress, one designated laminar shear stress and the other pulsatile shear stress, both of which take place during exercise.

Laminar shear stress occurs when blood flow increases over the endothelial surface which in turn mechanically distorts and realigns individual cells making this layer in contact with the blood stream. Pulsatile shear stress (PSS) occurs during the normal state of pulsatile blood flow as a function of heart rate that increases with exercise. It can also be increased by addition of pulses via a pulsatile pump over a steady flow pump in an in-vitro isolated perfused, blood vessel preparation where increased amounts of nitric oxide are detected. Palatini P, Mos L, Mormino P et al., "Blood pressure changes during running in humans: the 'beat' phenomenon," J Appl Physiol 1989; 67(1):52-59, showed that during running, each time the foot strikes the ground, a pulse is added to the circulation that is superimposed upon the body's own pulses and is detected in the radial arterial pressure waveform. In athletes, during warm-up, stride frequency ranges from 130-165/min, during submaximal speed, from 140-175/min, and during sprinting from 165-205/min. The addition of pulses during locomotion as well a whole body periodic acceleration increases pulsatile shear stress.

Normal vascular endothelial function is essential for maintenance of vascular health vasomotor control of both conduit and resistance vessels. These functions are due to the production of numerous autacoids, of which nitric oxide (NO) has been the most widely studied and important. Exercise training has been shown, in many animal and human studies, to augment endothelial, NO-dependent vasodilatation in both large and small vessels.

The extent of the improvement in humans depends upon the muscle mass subjected to training; with forearm exercise, changes are restricted to the forearm vessels while lower body training can induce generalized benefit. Increased NO bioactivity with exercise training has been readily and consistently demonstrated in subjects with cardiovascular disease and risk factors, in whom antecedent endothelial dysfunction exists. These conditions may all be associated with increased oxygen free radicals which impact on NO synthase activity and with which NO reacts; repeated exercise and shear stress stimulation of NO bioactivity redresses this radical imbalance, hence leading to greater potential for autacoid bioavailability.

Human studies indicate that exercise training improves endothelial function by up-regulating endothelial nitric oxide synthase (eNOS) protein expression and its active phosphorylated form that acts upon circulating L-Arginine to produce nitric oxide. While the increase in NO bioactivity dissipates within weeks of training cessation, studies indicate that if exercise is maintained, the short-term functional adaptation is succeeded by NO-dependent structural changes, leading to arterial remodeling and structural normalization of shear.

Today, most jobs and leisure time activities involve hours of continuous sitting. The underlying nature of sitting does not promote muscular contractions, augmented energy expenditure, or increased blood flow. Sitting also changes the angle at which major arteries (femoral and popliteal) run; as compared to a standing or supine posture. Bends within the arterial tree alter flow patterns which have been shown to affect the atherosclerotic process. Due to the predominantly seated posture during sedentary activity, turbulent blood flow might be augmented in deformed arterial segments of the lower extremities. The turbulent flow may also be an underlying mechanism for the prevalence of atherosclerosis in the femoral-popliteal arterial segment. Additionally, shear rate (estimate of shear stress without accounting for blood viscosity) is lower in the femoral artery versus the brachial artery in the supine, standing, and seated positions. Perhaps repeated sedentary activity presents a chronic stimulus in the lower extremity which promotes the development of atherosclerosis. In the seated posture, blood pools in the leg, and both peripheral resistance and blood pressure in the leg increase. Sitting upright produces low mean shear stress in the legs as compared to the supine position, which over time may influence endothelial function. Low mean shear stress due to sedentary activity elevates oxidative stress that promotes atherogenesis. Low shear stress decreases endothelial nitric oxide synthase (eNOS) expression which leads to decreased bioavailability of nitric oxide and oxidative stress Along these lines, Thosar S S, Johnson B D, Johnston J D et al., "Sitting and endothelial dysfunction: the role of shear stress." Med Sci Monit 2012; 18(12): RA173-RA180 showed that sedentary mice have an increased superoxide production. In this study, inactivity promoted NADPH oxidase activity leading to increased oxidative stress.

Along these lines, oscillatory flow or low shear stress promotes atherosclerosis (atheroprone), endothelial dysfunction and inflammation that can be combated by exercise by exercise or by anything that introduces additional pulses into the circulation such as whole body periodic acceleration. The latter adds pulses as a function of the frequency of repetitively moving a supine subject on a motorized platform head to foot to and fro about 100 to 180 times a minute. As the body is repetitively accelerated and decelerated, small pulses are added to the circulation which are superimposed upon the normal pulse. This increases pulsatile shear stress that activates a host of endothelial genes of which stimulation of endothelial nitric oxide synthase to increase release of nanomolar amounts of nitric oxide into the circulation is among the most important of this effect.

Pulsatile (PSS) and laminar shear stress (LSS) during exercise or in the case of PSS whole body periodic acceleration (WBPA) cause the release of beneficial mediators: 1) vasodilators—nitric oxide (NO), prostacyclin, endothelium derived hyperpolarizing factor, adrenomedullin, C-natruretic peptide, SIRT1, BH4; 2) antiproliferative—NO, prostacyclin, transforming growth factor-β, heparin; 3) antithrombotic—NO, prostacyclin, tissue plasminogen activator (tPA), protein C, tissue factor inhibitor, 3) angiogenesis—vascular endothelial growth factor (VEGF).

Potentially deleterious substances released from the endothelium during low or oscillatory shear stress include: 1) vasoconstrictors—endothelin-1, angiotensin-II, thromboxane A2, oxygen free radicals, prostaglandin H2; 2) pro-proliferative—endothelin-1, angiotensin-II, free oxygen radicals, platelet-derived growth factor, basis fibroblast growth factor, insulin-like growth factor, arginases; 3) prothrombotic—endothelin-1, free oxygen radicals, plasminogen inhibitor-1, thromboxane A2, fibrinogen, tissue factor; 4) inflammatory markers—cell adhesion molecules (P- and E-selectin, ICAM, VCAM), chemokines, nuclear factor kappa beta (NF-κβ) and STAT3.

In addition to the direct activity of these substances, many have signaling activity for other substances. For example, pulsatile and laminar shear stress that increase endothelial derived NO which in turn may increases brain derived neurotrophic factor (BDNF) and glial derived neurotrophic factor (GDNF) as well as SIRT1 in brain and muscle. In addition to the increased activity of endothelial nitric oxide synthase (eNOS) in the endothelium, PSS increases eNOS in the myocardium and neuronal nitric oxide synthase (nNOS) in heart and skeletal muscle. Nitric oxide released from activation of eNOS promotes release of endothelial progenitor cells and stem cells from the bone marrow into the circulation, a necessity for neovascularization.

Pulsatile shear stress (PSS) increases Kruppel-Like Factor-2 (KLF2) that is necessary for up-regulation of eNOS & thrombomodulin, activates SIRT1 that acts to prevent vascular cellular senescence, dysfunction and atherosclerosis and upregulates GTPCH I, the rate-limiting enzyme of BH4 biosynthesis, favoring NO over superoxide generation by eNOS thereby preventing and treating eNOS uncoupling. All these actions promote a healthy endothelium and improve endothelial dysfunction.

Williams C B, Gurd B J, "Skeletal muscle SIRT1 and the genetics of metabolic health: therapeutic activation by pharmaceuticals and exercise," Appl Clin Genet 2012; 5:81-91, provides interesting insights into the place of exercise, with beneficial mediator activation due to increased laminar and shear stress as is also the case with WBPA, in management of obesity and metabolic disease, exercise has several inherent advantages over pharmaceutical intervention.

First, the improved metabolic function associated with exercise comes at minimal financial cost, while a pharmaceutical intervention carries a substantial financial commitment from both the individual and healthcare provider. Second, in addition to improved skeletal muscle mitochondrial function and metabolic/cardiovascular health, regular exercise is associated with a myriad of beneficial effects ranging from the prevention and treatment of mental disorders and cancer to alleviating symptoms and improving quality of life in many chronic diseases. Third, exercise is implicated in a systemic improvement of health with little to no risk of adverse side effects. Pharmaceuticals are often associated with undesirable side effects, and are inherently designed to be specific, eliminating the possibility of a systemic health improvement. Finally, there is evidence that exercise, as part of a lifestyle intervention, induces superior improvements compared to pharmaceutical intervention in subjects with metabolic disease. In light of these arguments, it makes both health and financial sense that exercise becomes a first-line tool in both the prevention and treatment of obesity and obesity-related disease Beneficial mediators such as NO derived from eNOS and others can counteract inflammatory mediators. For example, increased PSS produced by WBPA stimulates activity of eNOS to increase NO that blunts the late inflammatory response in allergic bronchial asthma through inhibition of nuclear factor kappa beta. NO is the most important beneficial mediator released by PSS; its actions are listed below.

Vasodilator: acts on vascular smooth muscle to increase cGMP (improves organ blood flow with substantial increases in cerebral blood flow and myocardial microvascular blood flow).

Anti-atherosclerotic: prevents adhesion of leukocytes & platelets to endothelium that cause endothelium dysfunction; prevents adhesion of leucocytes and platelets to endothelium that cause injury.

Anti-inflammatory: inhibits NF-κβ, STAT3, and inflammatory cytokines that together with free oxygen radicals (ROS) are responsible for pathogenesis of many chronic diseases.

Anticytokines: suppresses TNF-α and IL-1.

Antichemokines: downregulates MIP-1 and MIP-2.

Antiapoptotic: downregulates p53, inhibits human caspases, induces expressions of heat shock proteins.

Reduces oxidative stress: scavenges ROS and RNS; inhibits NADPH oxidase activity.

Anti-tumorigenic: inhibits NF-κβ activity and other protumorigenic genes.

Organ preconditioning, conditioning & postconditioning: minimizes deleterious effects of ischemia to heart, brain, gut, lungs, liver, kidneys and skeletal muscles.

Anti-diabetogenic: promotes glucose uptake by cardiac and skeletal muscles as well as adipose tissues; combats microvascular complications.

Modulates corticostriatal plasticity: strengthens interconnections at neural synapses thereby relieving movement, learning, & fatigue disorders in neurological diseases.

Minimizes cognitive decline with ageing.

Reverses ventricular remodeling.

Promotes wound & bone fracture healing.

Mobilizes endothelial progenitor cells (EPCs) from bone marrow: for vascular repair.

Signals increase of Brain and Glial Derived Neurotrophic Factors (BDNF & GDNF) and SIRT1.

Pulsatile Shear Stress and Diabetes

With respect to Type 2 diabetes associated with a sedentary life style, increased pulsatile shear stress as delivered by whole body periodic acceleration (WBPA) has immediate effects. Thus, 8 patients with T2D were studied before and immediately after a single session of 45-min session of WBPA for changes of coronary flow reserve (CFR), a measure of the capacity of myocardial microcirculation as well as their diabetic status. WBPA increased CFR from 2.3±0.3 to 2.6±0.4 (p=0.02). WBPA decreased serum insulin level from 26±19 IU/ml to 19±15 IU/ml (p=0.01) and increased total adiponectin from 11.6±7.3 g/ml to 12.5±8.0 g/ml (p=0.02) and high molecular weight adiponectin from 4.9±3.6 g/ml to 5.3±3.9 g/ml (p=0.03), whereas the serum glucose level was stable from 207±66 mg/dl to 203±56 mg/dl (p=0.8). This study demonstrates that a single session of WBPA treatment simultaneously improved coronary microcirculation and glucose tolerance in patients with T2D. Increased pulsatile shear stress delivered with WBPA was assessed on blood flow recovery in a mouse model of hindlimb ischemia and in patients with peripheral arterial disease. After unilateral femoral artery excision, mice were assigned to either the WBPA (n=15) or the control (n=13) group. WBPA was applied at 150 cpm for 45 minutes under anesthesia once a day. WBPA significantly increased blood flow recovery after ischemic surgery, as determined by laser Doppler perfusion imaging. Sections of ischemic adductor muscle stained with anti-CD31 antibody showed a significant increase in capillary density in WBPA mice compared with control mice. WBPA increased the phosphorylation of endothelial nitric oxide synthase (eNOS) in skeletal muscle. The proangiogenic effect of WBPA on ischemic limb was blunted in eNOS-deficient mice indicating that the stimulatory effects of WBPA on revascularization are eNOS dependent. Quantitative real-time polymerase chain reaction analysis showed significant increases in angiogenic growth factor expression in ischemic hindlimb by WBPA. Facilitated blood flow recovery was observed in a mouse model of diabetes despite there being no changes in glucose tolerance and insulin sensitivity. Furthermore, both a single session and 7-day repeated sessions of WBPA significantly improved blood flow in the lower extremity of patients with peripheral arterial disease. Thus, increased pulsatile shear stress increased blood supply to ischemic lower extremities through activation of eNOS signaling and upregulation of proangiogenic growth factor in ischemic skeletal muscle.

Diabetes is an important risk factor for the progression of Peripheral Arterial Disease (PAD). eNOS signaling plays an important role in endothelial dysfunction and vascular inflammation in the presence of insulin resistance. eNOS-dependent NO production is essential for the activation of insulin signaling. Therefore, increased shear stress through WBPA or aerobic exercise over the long term improves glucose tolerance and insulin sensitivity through phosphorylation of eNOS in heart and skeletal muscle as well as adipose tissue.

More recently, it has become apparent that SIRT1, which is increased by caloric restriction as well as pulsatile shear stress, is closely associated with lifespan elongation under CR. SIRT1 regulates glucose/lipid metabolism through its deacetylase activity on many substrates. SIRT1 in pancreatic β-cells positively regulates insulin secretion and protects cells from oxidative stress and inflammation, and has positive roles in the metabolic pathway via the modulation in insulin signaling. SIRT1 also regulates adiponectin secretion, inflammation, glucose production, oxidative stress, mitochondrial function, and circadian rhythms. Several SIRT1 activators, including resveratrol (present in small quantities in wine) have been demonstrated to have beneficial effects on glucose homeostasis and insulin sensitivity in animal models of insulin resistance.

MicroRNAs (miRs) in vascular endothelial cells play an essential role in shear stress-regulated endothelial responses. Atheroprotective pulsatile shear stress (PSS) induces miRs that inhibit mediators of oxidative stress and inflammation while promoting those involved in maintaining vascular homeostasis. Because multiple transcription factors are shear stress-inducible, a myriad of miRs can be induced or repressed by shear stress-inducible transcription factors. One of these transcription factors is Kruppel-Like Factor-2) (KLF2). This upregulates endothelial nitric oxide synthase (eNOS), thrombomodulin, and nuclear factor erythroid 2-related factor 2 that exert antiinflammatory, antithrombotic, and antioxidative effects in endothelial cells. Under PSS, the downregulation of adhesion molecule 1 (ICAM-1), VCAM-1, and E-selectin is likely to prevent the degradation of IκB and the consequent nuclear translocation of NF-κB p50 and p65 subunits. Both shear stress-sensitive miR-30b and miR-10a directly inhibit VCAM-1 and E-selectin. Additionally, the PSS—sensitive miR-181b inhibits the NF-κB pathway by directly targeting importin-α3 to decrease nuclear accumulation of p50 and p65 PSS is atheroprotective because it activates myocyte enhancer factor-5 (MEF5)/ERK5/MEF2 and AMP-activated protein kinase (AMPK) pathways, which merge at the transcriptional upregulation of KLF2. The beneficial anti-inflammatory effects and interactions with genes, cells and transcription factors have been aptly summarized by Marin and associates.

Laminar blood flow as well as caloric restriction increase SIRT1 level and activity, mitochondrial biogenesis, and expression of SIRT1-regulated genes in cultured endothelial cells (ECs). When the effects of different flow patterns are compared in vitro, SIRT1 level was significantly higher in ECs exposed to physiologically relevant pulsatile flow than oscillatory flow. Endothelial dysfunction (which is signified by increased oxidative and inflammatory responses) predisposes the arteries to atherosclerosis. Hence, SIRT1 activation by pulsatile flow may prevent EC dysfunction and counteract the risk factors associated with atherosclerosis. Compared with therapeutic interventions such as resveratrol (a substance in wine touted for its potential lengthening of life span), shear stress is more physiologically relevant to a direct effect on increasing SIRT1.

The application of laminar flow increases SIRT1 level and activity, mitochondrial biogenesis, and expression of SIRT1-regulated genes in cultured endothelial cells (ECs). When the effects of different flow patterns were compared in vitro, SIRT1 level was significantly higher in ECs exposed to physiologically relevant pulsatile flow than pathophysiologically relevant oscillatory flow. It is known that endothelial dysfunction (which is signified by increased oxidative and inflammatory responses) predisposes the arteries to atherosclerosis. Hence, SIRT1 activation by pulsatile flow may prevent EC dysfunction and counteract the risk factors associated with atherosclerosis. Compared with therapeutic interventions such as resveratrol and several small molecules developed for SIRT1 activation, shear stress is more physiologically relevant and pulsatile shear stress optimal.

SIRT1 plays an important role in maintaining neuronal health during aging. Hypothalamic functions that affect feeding behavior, endocrine function, and circadian rhythmicity are all regulated by SIRT1. Finally, SIRT1 plays protective roles in several neurodegenerative diseases including Alzheimer's, Parkinson's, and motor neuron diseases, which may relate to its functions in metabolism, stress resistance, and genomic stability.

Although the relevance of SIRT1 as a longevity gene has been disputed, its activation prevents diet-induced obesity and overexpression limits the risk of cancer and can thereby affect lifespan. As such, SIRT1 should be considered as a candidate for preventing and/or treating age-related diseases and for increasing healthspan. In fact, in contrast to increasing lifespan, which has limited medical relevance, improving healthspan has an immediate clinical and public health impact, given the ever increasing 'greying' of the world population.

Activation of SIRT1 has been observed in human skeletal muscle after 2 weeks and 6 weeks of exercise training. Consistent with these observations, exercise training improves oxidative capacity and fatty acid oxidation in skeletal muscle from obese adults, improves insulin sensitivity in obesity and type II diabetes, and decreases both risk factors for, and symptoms of, metabolic disease. In summary, exercise appears to activate the SIRT1/PGC-1α axis and improve skeletal muscle mitochondrial function and metabolic health. These results highlight the preventative and therapeutic potential of exercise for obesity and obesity-related disease.

Apparatuses are known that are intended to the solve problems relating to the sedentary lifestyle described above.

U.S. Pat. No. 4,862,875 to Heaton, Samuel discloses a leg exerciser for use by a person sitting in a chair. The device is located in front of the chair and the user puts his feet onto two boards which are at an acute angle to the horizontal. A mechanism, including a drive motor or flywheel inside the device, rocks the boards anti-phase about a horizontal axis lying transverse to the feet between acute angle positions. Sections of the boards lift out of and back into the planes of the boards during each cycle of rocking to lift and lower the user's toes relative to the remainder of the feet so that the feet are subjected to exercise movements similar to walking movements. The exerciser drives the leg blood pump with a view to improving the user's leg circulation. However, it does not supply useful mediators or pulsatile sheer stress.

U.S. Pat. No. 7,090,648 to Sackner, Marvin A. et al. relates to external addition of pulses to fluid channels of body to release or suppress endothelial mediators and to determine effectiveness of such intervention. A method of treatment is shown in which periodic acceleration is applied to the patient's fluid filled channels, thereby stimulating endothelial release of beneficial mediators and suppressing non-beneficial mediators. The periodic acceleration is provided by a reciprocating movement platform, which periodically accelerates the body, or a part thereof, in a head-wards-footwards direction at a defined frequency.

One disclosed portion of this patent relates to a means for shifting the patient's legs up and down while the patient is seated, using an adjustable frequency, rotary motor mechanism that is cam adjustable for vertical displacement. While this relates to applying periodic acceleration of the legs, no mention is made of how it is accomplished.

U.S. Pat. No. 8,323,156, to Ozawa, Takahisa et al., relates to a piece of equipment that exercises the legs of a user without excessively straining the knee joint. However, the equipment is not configured to apply pulsatile stress to the patient's fluid filled channels.

Roberts V C, Sabri S, Pietroni M C et al., "Passive flexion and femoral vein flow: a study using a motorized foot mover," Br Med J 1971; 3 (5766):78-81 describes a machine used to produce the controlled passive flexion of the foot (foot mover) is shown in the FIG. 12. The machine is intended for use on supine subjects, whether conscious or unconscious, and can be clamped to any operating table or bed as required. It consists essentially of a foot board which is pivoted in the region of the ankle. The feet are held in contact with the board, controlled oscillation of which is produced by an electrically driven crank mechanism. By suitable adjustment of the crank mechanism, the foot can be flexed through an angle of 0° about the vertical. However, this device is not intended for use while sitting and does not have structure for providing a pulsatile effect, e.g., to the patient's fluid filled channels.

McAlpine D A, Manohar C U, McCrady S K et al., "An office-place stepping device to promote workplace physical activity," Br J Sports Med 2007; 41(12):903-907, describes stepping device that is easily movable, and can be housed under a desk and transported in a standard overnight case. The device has an accelerometer-containing, micro-electronic system that detects the motion of when the stepper is in use. The accelerometer is a tri-axial micro electro mechanical systems accelerometer that is equipped with USB functionality that enables the sensor to interface with a personal computer (PC) via a standard USB cable. The software then enables the user to monitor the use of the office-place stepping device from a PC. However, as with a treadmill desk discussed above, this device provides an active exercise of the user and hence requires multitasking, limiting the efficiency of work being done by the user.

Shimomura K, Murase N, Osada T et al., "A study of passive weight-bearing lower limb exercise effects on local muscles and whole body oxidative metabolism: a comparison with simulated horse riding, bicycle, and walking exercise," Dyn Med 2009; 8:4, includes a description of a prototype machine to passively exercise the lower limbs. This equipment is composed of a saddle on which a subject sits, a rod to support the saddle, and two foot plates attached at the oblique front position to mount the feet. The saddle is adjustable for height so that the subject can do half-loaded exercise by keeping the flexion angle of the knee constant. The body weight of the subject was thus supported at three points by the saddle and both foot plates. The device induced motorized movements that moved the saddle repetitively in the front oblique direction.

In order to reduce pain associated with knee joint motion that might occur during exercise, the foot plates are designed to move downward in harmony with the support rod motion, which allows the subject to do exercise while maintaining the knee joint angle because the distance between the saddle and foot plates was constant. Repeated alternate right or left side shifts of the subject's center of gravity caused by oblique movements of the support rod imposed a larger amount of load on the lower limbs on the side of the slanted rod because the limbs were mobilized to regain body balance. The exercise intensity can be changed by varying the slant cycles. Intensities at 0.8, 1.2, and 1.6 Hz for 3 minutes each with a 5-minute rest between performances were studied. Passive weight-bearing lower limb exercise using this machine could provide approximately 3 MET of exercise and the thigh exhibited muscle activity equivalent to that of 80-watt bicycle or 6 km/hr walking exercise.

However, because of the extensive motion required, this machine cannot be used in an office environment and would require difficult multitasking in work related activities. In addition, the passive movement of this device is controlled by motorized rocking of the seat, and not the passive movement of the feet.

In view of the above, there is a need for a portable device that permits a user to achieve the benefits of application of pulsatile shear stress to the endothelium while still being able to perform other tasks, such as multi-tasking.

SUMMARY OF THE INVENTION

In view of the foregoing, it is an object of the present invention to provide an apparatus that provides the therapeutic potential of exercise but without the need for exertion by the user, and in particular which provides the therapeutic release of beneficial substances into the circulation of the user by rocking the feet of the user and applying tapping to the feet, thus increasing pulsatile shear stress to the endothelium, while permitting the user to multi-task.

According to a first aspect of the invention, a motorized machine for passively applying a tapping force to the bottoms of a user's feet includes: a housing; an axis-defining mechanism coupled to the housing, the axis-defining mechanism configured to define a rocking axis; at least one pedal positioned to receive a foot of the user and mounted on the rocking axis for rocking movement of the at least one pedal; a motor arranged within the housing, the motor configured to generate rotational motion to an output shaft of the motor; a pedal rocking mechanism coupled to the output shaft and driven by the motor, the pedal rocking mechanism being configured to translate the rotational motion generated by the motor to reciprocating rocking up and down motion of the at least one pedal about the rocking axis; and at least one bumper, height-adjustably coupled to the housing, located under a bottom portion of the at least one pedal. The motor, the pedal rocking mechanism, the at least one pedal and the at least one bumper are configured so as to cooperate to, during operation of the motor, cause the bottom portion of the at least one pedal to tap against the at least one bumper so as to provide pulsatile acceleration to the bottom of the user's foot, the pulsatile acceleration having a force sufficient to increase pulsatile shear stress to the endothelium, of sufficient magnitude to cause the release of beneficial mediators.

In another aspect, the at least one pedal has two pedals, one for each foot of the user and the at last one bumper has two bumpers, one for each of the two pedals.

In another aspect, the rocking of one of the two pedals is anti-phase with the rocking of the other of the two pedals.

In another aspect, the rocking of one of the two pedals is in-phase with the rocking of the other of the two pedals.

In another aspect, the pedal rocking mechanism has: a camshaft coupled to the output shaft of the motor; two cams, each cam eccentrically coupled to an end of the camshaft; and two pedal coupling mechanisms, each corresponding to one of the two pedals, each pedal coupling mechanism configured to contact one of the two cams, the cam cooperating with the pedal coupling mechanism to convert rotational motion of the cam to reciprocating motion of the pedal coupling mechanism so as cause the rocking motion of the pedals.

In another aspect, the camshaft is coupled to the output shaft of the motor by a pulley and belt mechanism.

In another aspect, the camshaft is coupled to the output shaft of the motor by a gear mechanism.

In another aspect, the height adjustment of the two bumpers provides a tapping force to the bumper of approximately 0.1 to 0.5 g.

In another aspect, the beneficial mediators include at least one from the group consisting of: nitric oxide, prostacyclin, tissue plasminogen activator, adrenomedullin, SIRT1, Brain and Glial Derived Neurotrophic Factors (BDNF & GDNF), Kruppel Like Factor 2, Superoxide Dismutase, Glutathione Peroxidase 1, Catalase, Total Antioxidant Capacity, and Anti Apoptotic Proteins: p-Akt, Bcl2, and Bcl2/Bax, HSP27.

In another aspect, the pulsatile acceleration to the user having a force sufficient to increase pulsatile shear stress to the endothelium is of sufficient magnitude to suppress inflammatory and pro-cancergenic factors, including at least one from the group consisting of: nuclear factor kappa beta, endothelin-1, STAT3, and Pro-Apoptotic Proteins: Fas, TRAILR2, Bad, Caspase 3,8.

In another aspect, the tapping provides pulsatile acceleration to the user having a force sufficient to increase pulsatile shear stress as related to the addition of pulses into the vascular circulation, heart, lymphatic channels, interstitial spaces, skeletal muscle and bone interstices, as well as slight increases of cyclic strain to the blood vessels and lymphatic channels.

In another aspect, the tapping provides pulsatile acceleration to the user having a force sufficient to increase the activity and content of endothelial nitric oxide synthase (eNOS) in blood vessels, heart and skeletal muscle, as well as to increase the activity of neuronal nitric oxide synthase (nNOS) in the heart and skeletal muscle.

In another aspect, the efficacy of treatment using the motorized machine after a single or multiple sessions over a single duration of from about 10 to 30 minutes or more can be ascertained by sensing release of nitric oxide into the circulation by one or more of the following: a) descent of the dicrotic notch of the pulse waveform from any non-invasive or invasive technology that provides a raw arterial pulse waveform with a photoplethysmographic sensor placed upon the finger and/or ear, b) fall in blood pressure measured by conventional means from baseline and during treatment upon termination of treatment that may last several minutes, and/or c) a subjective, pleasant feeling of warmth and tingling over the skin of the lower extremities that may rise upwards toward the head.

In another aspect, the motor is a DC brushless motor.

In another aspect, the machine further comprises an input for supplying power to the motor.

According to another aspect of the present invention, a method of treatment using the motorized machine includes: repeatedly adding pulses and minimally increasing cyclic strain, using the striking of the bumper with the foot pedals, to the body's fluid filled channels over the body's own pulse such that even during periods when pulses are not imparted, bioavailability of the beneficial mediators is greater than the preoperational period.

According to another aspect of the present invention, a method of treatment using the motorized machine includes: adding pulses, using the striking of the bumper with the foot pedals, to the body's fluid filled channels over the body's own pulse sufficient to stimulate endothelial release of at least one of nitric oxide, prostacyclin, tissue plasminogen activator (t-PA), adrenomedullin, endothelial dependent hyperpolarizing factor (EDHF), endothelial dependent relaxing factor, endothelial growth factors, and transcription factors.

According to another aspect of the present invention, a method of treatment using the motorized machine includes: adding pulses, using the striking of the bumper with the foot pedals, to the body's fluid filled channels over the body's own pulse sufficient to increase the activity and content of endothelial nitric oxide synthase (eNOS) in blood vessels, heart and skeletal muscle, as well as to increase the activity of neuronal nitric oxide synthase (nNOS) in the heart and skeletal muscle.

In another aspect, release of nitric oxide from eNOS stimulated by pulsatile shear stress brought about by the added pulses increases release of endothelial progenitor and CD34 cells into the circulation from bone marrow that serve a reparative role in damaged vascular endothelium as occurs in arteriosclerosis.

In another aspect, activation of neuronal nitric oxide synthesis (nNOS) stimulated by pulsatile shear stress brought about by the added pulses increases vagal nerve tone as measured by heart rate variability so as to produce several beneficial actions including suppression of adverse immunologic substances that can be elevated in disease states such as tumor necrosis factor alpha (TNF-$\alpha$).

In another aspect, the foot pedals, when driven in rocking motion by the motor, are configured to passively move the feet in a reciprocal sinusoidal up and down motion with one end of the foot board actively rising and falling approximately 1.25" with the other end serving as a pivot point around the rocking axis, and the two foot pedals are set approximately 12" apart on the horizontal plane.

In another aspect, the machine further includes a mounting bracket, arranged at the bottom of the machine, to facilitate mounting of the machine on a vertical support, so as to permit use of the machine by a user lying in a bed.

BRIEF DESCRIPTION OF THE DRAWINGS

The above and/or other aspects and advantages will become more apparent and more readily appreciated from the following detailed description of the disclosed embodiments taken in conjunction with the accompanying drawings in which.

DETAILED DESCRIPTION

Basis of Present Invention

Dicrotic Notch of Finger Pulse Wave

The demonstration that whole body periodic acceleration (WBPA) in humans produced increased pulsatile shear stress to the endothelium with subsequent release of nitric oxide into the circulation was based upon analysis of the digital pulse wave. Direct measurement of NO in humans is not possible since NO is metabolized within 4 seconds. Descent of the dicrotic notch or wave of the digital pulse down the diastolic limb reflects the vasodilator action of NO on the resistance vessels owing to delay in pulse wave reflection. This phenomenon has been noted with endothelial-independent preparations of organic nitrates as well as with endothelial dependent agents such as albuterol and terbutaline, adrenergic agonists that act through the NO pathway. The change of dicrotic notch or wave position is computed by measuring the amplitude of the digital pulse wave divided by the height of the dicrotic notch or wave above the end-diastolic level (a/b ratio); alternately, the height of the dicrotic notch or wave above the end-diastolic level divided by the amplitude of the digital pulse wave ratio may be reported. In the current study, the dicrotic notch rather than the dicrotic wave was utilized to compute the a/b ratio since the peak of the reflective wave particularly at baseline was usually difficult to detect in elderly subjects. The a/b ratio increases when nitric oxide is released into the circulation and this change is specific for an acute rise of nitric oxide in the circulation.

Figure 1:
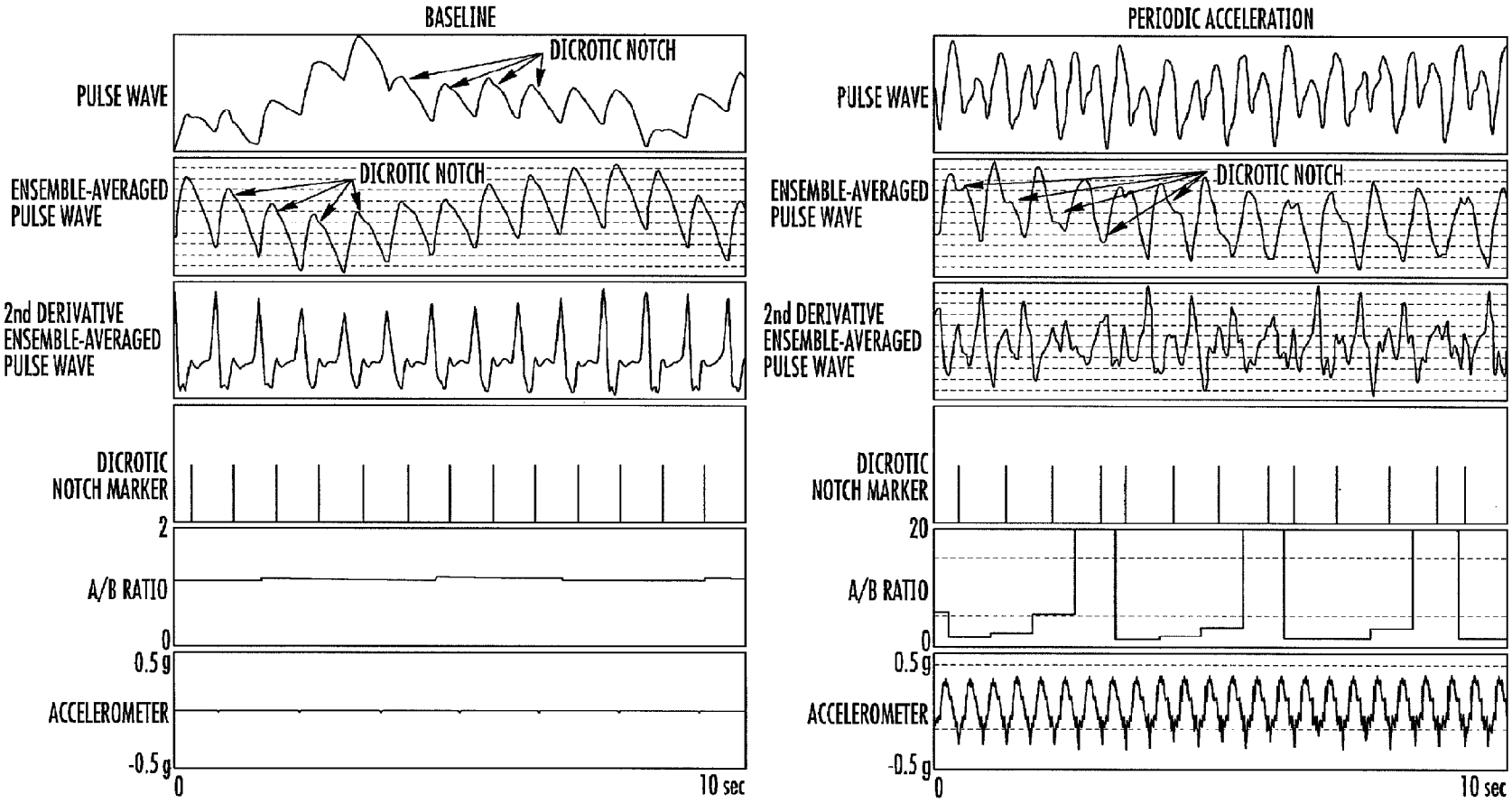
FIG. 1 is a diagram showing the effects of the present invention in relation to the dicrotic notch of the finger pulse wave.

Cyclic variation of the dicrotic notch in a patient with fibromyalgia is shown in FIG. 1. The left side of the figure shows pulse wave and the seven-beat, ensemble-averaged from R-wave of electrocardiogram triggered pulse wave at baseline. Each pulse wave of the ensemble-averaged pulse represents an average of the seven preceding pulses. The dicrotic notch is marked as the peak, large upward deflection in diastole of the second derivative of the ensemble-averaged waveform. The a/b ratio is computed on a pulse-by-pulse basis. The right side shows, during whole-body, periodic acceleration, added pulses and movement artifacts obscure the dicrotic notch position of the raw pulse wave. The ensemble-averaged pulse depicts cyclic variation of the dicrotic notch position and a/b ratios. The latter is a trace that automatically depicts a/b ratios on a beat-by-beat basis.

In the disclosed embodiments of the present invention, repeated contact is provided to the feet of a user, such as by a tapping motion, to supply pulsatile acceleration to the user. As described below, passive movement is applied only to the feet such that the finger is isolated from motion artifacts while the added pulses are too small to be depicted on the digital pulse wave. In contrast to the digital pulse wave observed during whole body periodic acceleration, in using the present invention, there is no need to ensemble-average several beats with the R wave of an electrocardiograph as shown below.

FIGS. 2-8 and 11 show an exemplary embodiment of an apparatus in accordance with the present invention. The apparatus according the first embodiment includes a pair of foot pedals, each of which are driven to up and down, rocking movement about an axis transverse to the feet, preferably alternating, i.e., anti-phase, motion of the two foot pedals.

As will be seen from the description below, the apparatus is configured such that each movement of the foot pedals can be associated with a percussive contact of a portion of the underside of the foot pedal, which percussive contact passes along to the user a pulsatile impact which, as is discussed above, increases shear stress to mechanically stimulate the endothelial cells to increase the activity of genes responsible for release of beneficial mediators. In particular, the tapping simulates the beneficial effects that occur, for example, while running, in which Pulsatile shear stress (PSS) is increased by addition of pulses generated by the tapping. By virtue of this feature of the present invention, a pulse is added to the circulation that is superimposed upon the body's own pulses and is detected in the radial arterial pressure waveform.

In a typical operation of the apparatus, the feet will be placed on the pedals such that the toes will be raised (and then lowered) in relation to the heels by the rocking of the pedals, and the tapping applied to the toe portion of each foot. However, the apparatus is advantageously symmetrical in design so as to permit the heels, rather than the toes, to be raised and lowered, by the user turning the apparatus around 180° and placing his or her feet in the opposite direction. Such reversed usage of the apparatus results in the pulse being delivered to the heel of the user rather than to the toe.

As can be seen in FIGS. 2-8, the apparatus 1, in accordance with an embodiment of the present invention, includes a housing top 14, a housing bottom 15, and left and right foot pedals, 10 and 12, having surfaces 11*a* and 11*b*, respectively, for receiving the feet of a user. The bottom of the apparatus preferably includes bottom stabilizer posts 13, e.g., made of rubber, to contact the ground, provide a leveling function and prevent slippage of the apparatus during use.

Figure 2:
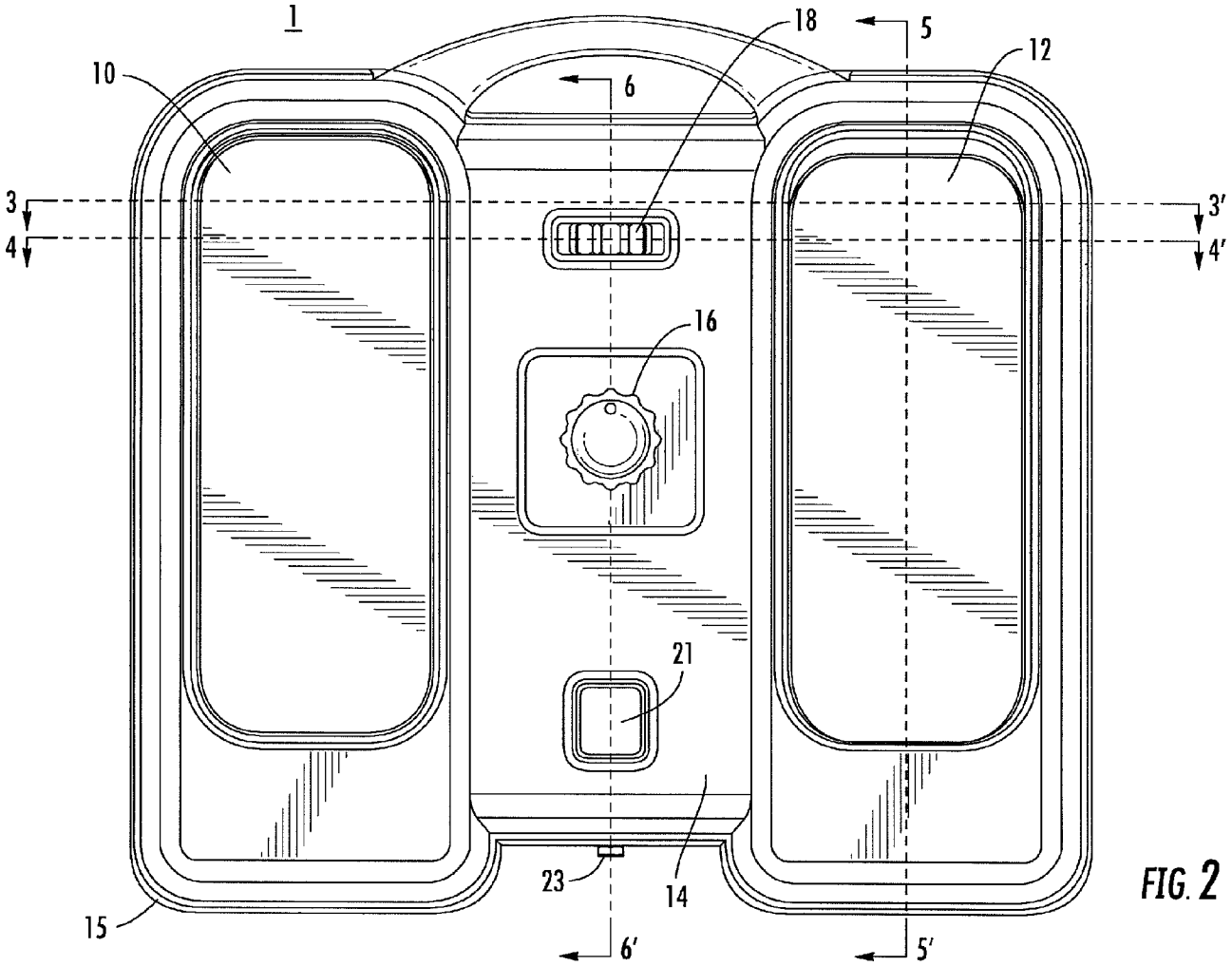
FIG. 2 is a plan view of an apparatus in accordance with an embodiment of the present invention.
Figure 3:
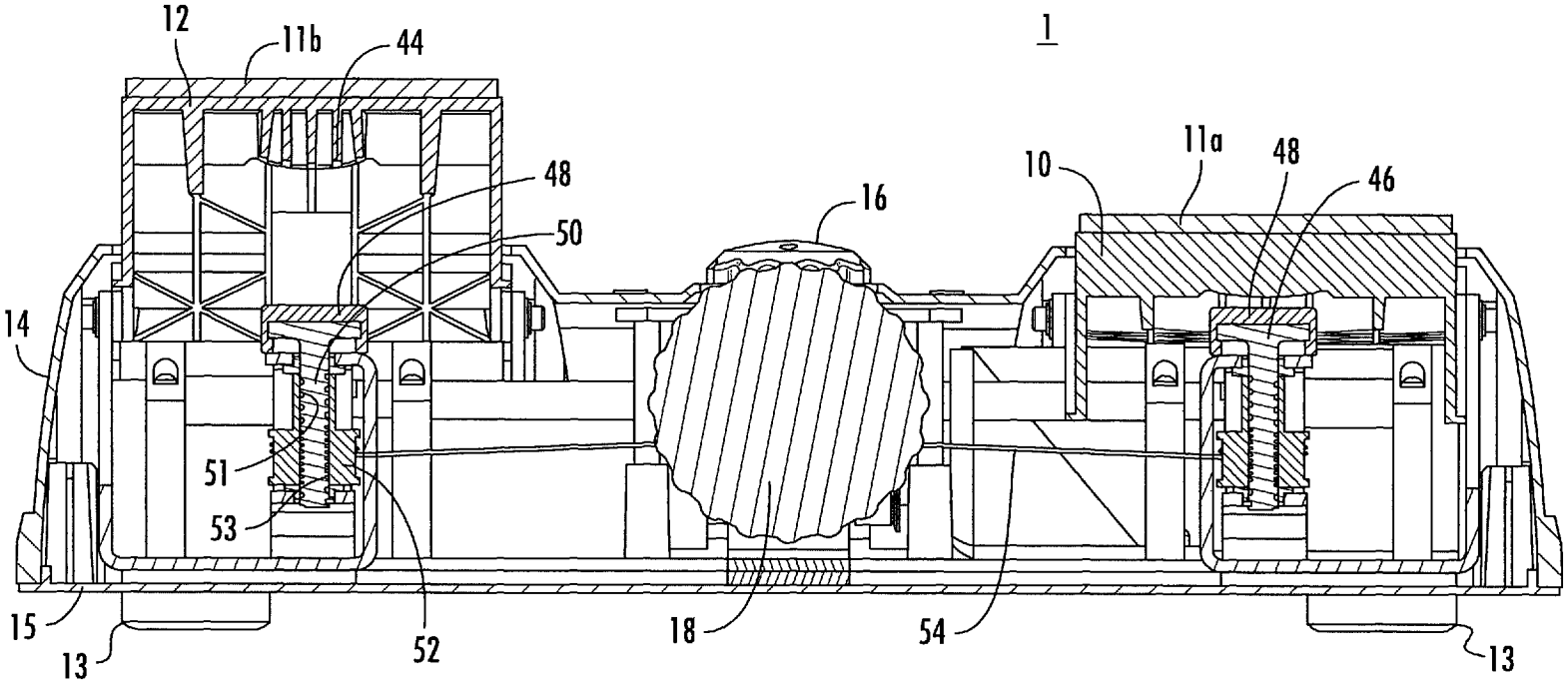
FIG. 3 is a section view taken along the lines 3-3' in FIG. 2.
Figure 4:
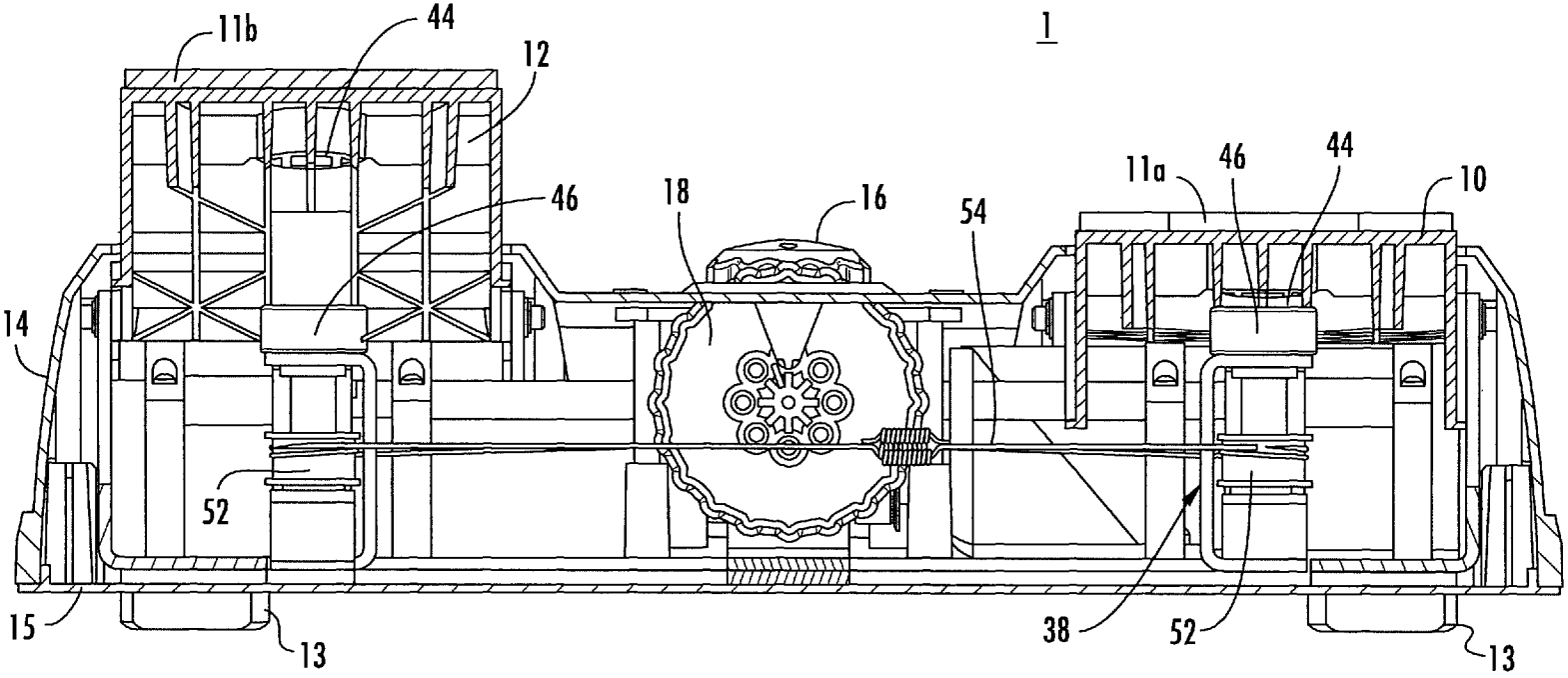
FIG. 4 is a section view taken along the lines 4-4' in FIG. 2.
Figure 5:
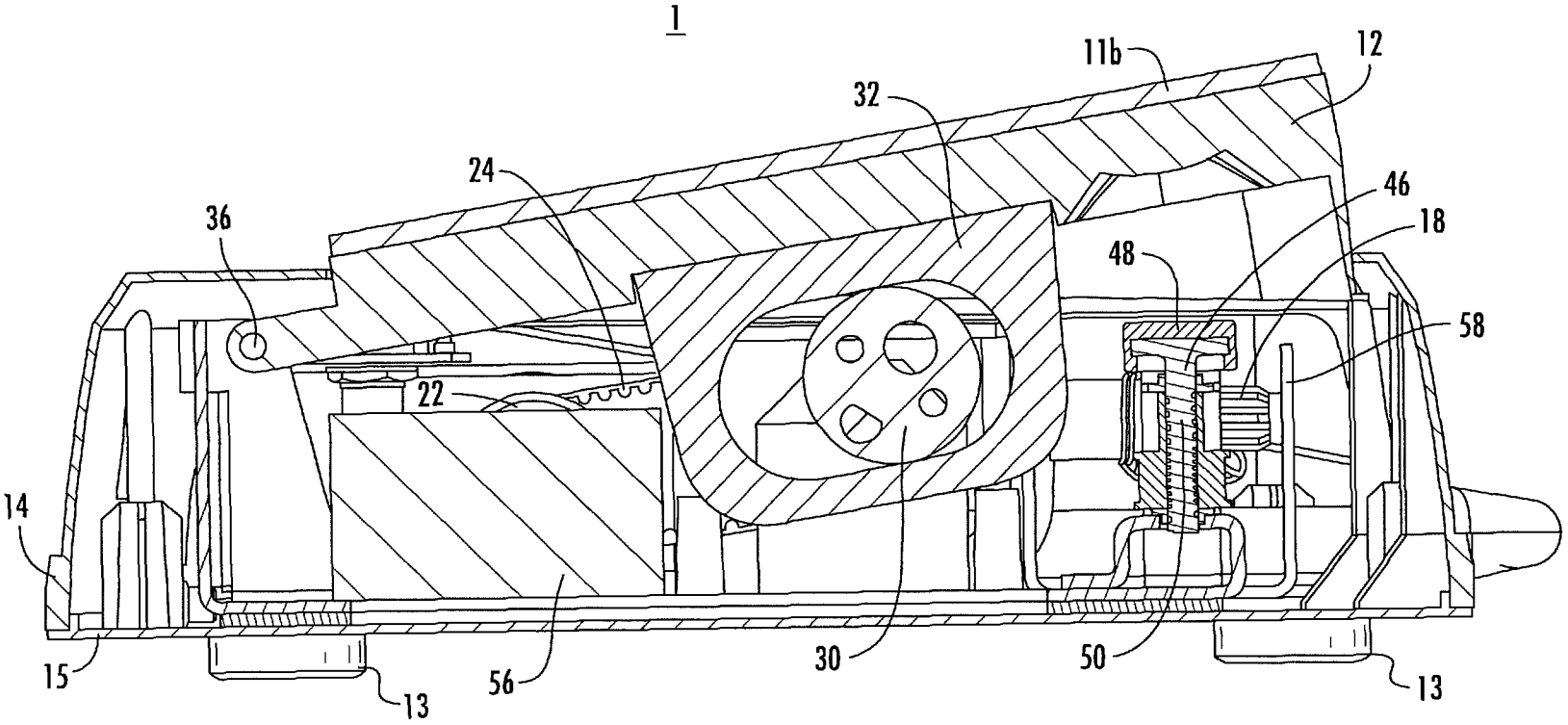
FIG. 5 is a section view taken along the lines 5-5' in FIG. 2.
Figure 6:
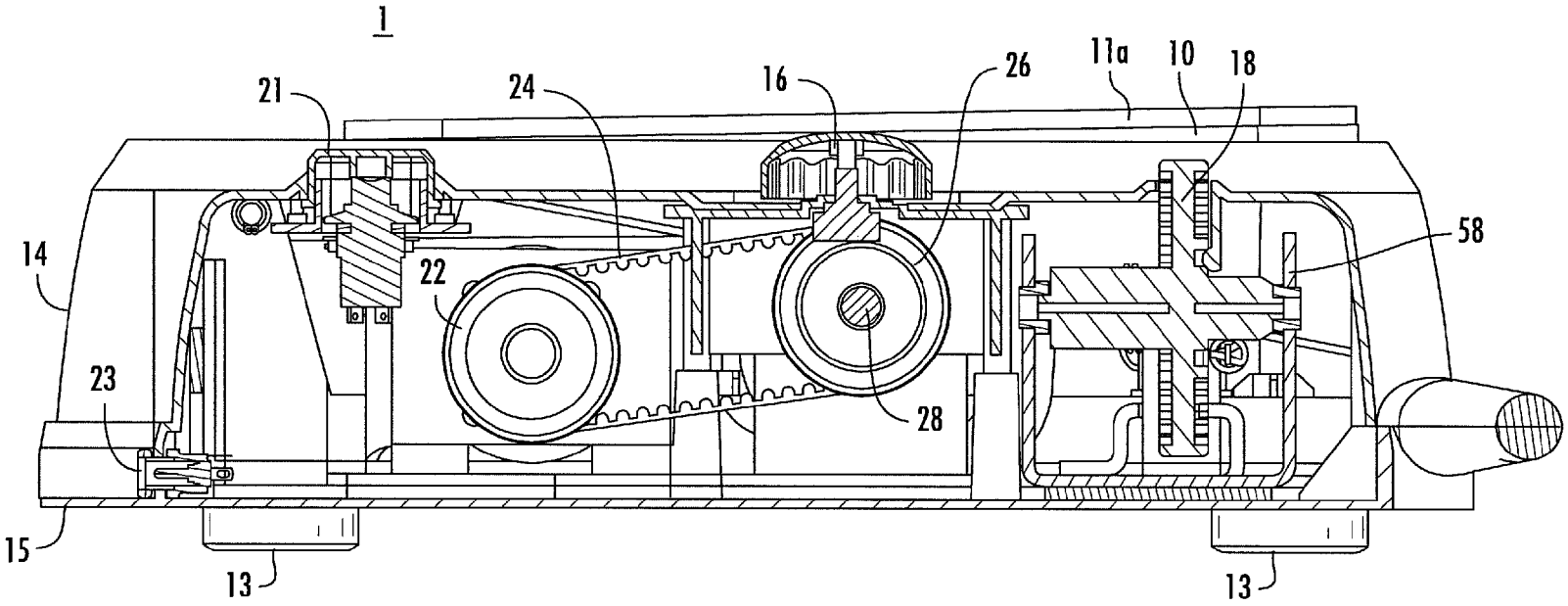
FIG. 6 is a section view taken along the lines 6-6' in FIG. 2.

As can be seen, for example, in FIG. 2, the exercise device 1 may include a speed adjustment control 16, which can vary the speed of the up and down motion of the pedal 10 and 12. The adjustment control can be in the form of a knob, switch, lever or other user-selectable device. As an example, the control 16 is depicted in the figures as a knob. The housing top 14 and housing bottom 15 are preferably coupled to one another using screws 17.

As will be described in more detail below, a force adjustment control 18 is provided, a portion of which is accessible through an opening in the housing top 14 to allow adjustment of the intensity of tapping or striking force provided by the device 1. As will be discussed further below, the ability to adjust the speed of the up and down motion of the pedals 10, 12 is optional and may be omitted. Thus, in a variation of the disclosed embodiment, the apparatus does not include the adjustment control knob 16, but rather operates at a set speed approximating the average steps per minute during jogging of 140-150 steps per minute. The set speed is based upon the observation that steps per minute during jogging at 4 mph, or a 15 minute mile, or 4.3 mph, or a 14 minute mile, is 140 steps per minute or 150 steps per minute, respectively, see, for example, http://www.ontherunevents.com/ns0060.htm, and, in the case of adjustable speed configuration, may be set to approximately 60 to 180 steps per minute, and preferably, in a single speed configuration, set to approximately 140 or 150 steps per minute, a speed similar to typical jogging, as discussed above.

Figure 7:
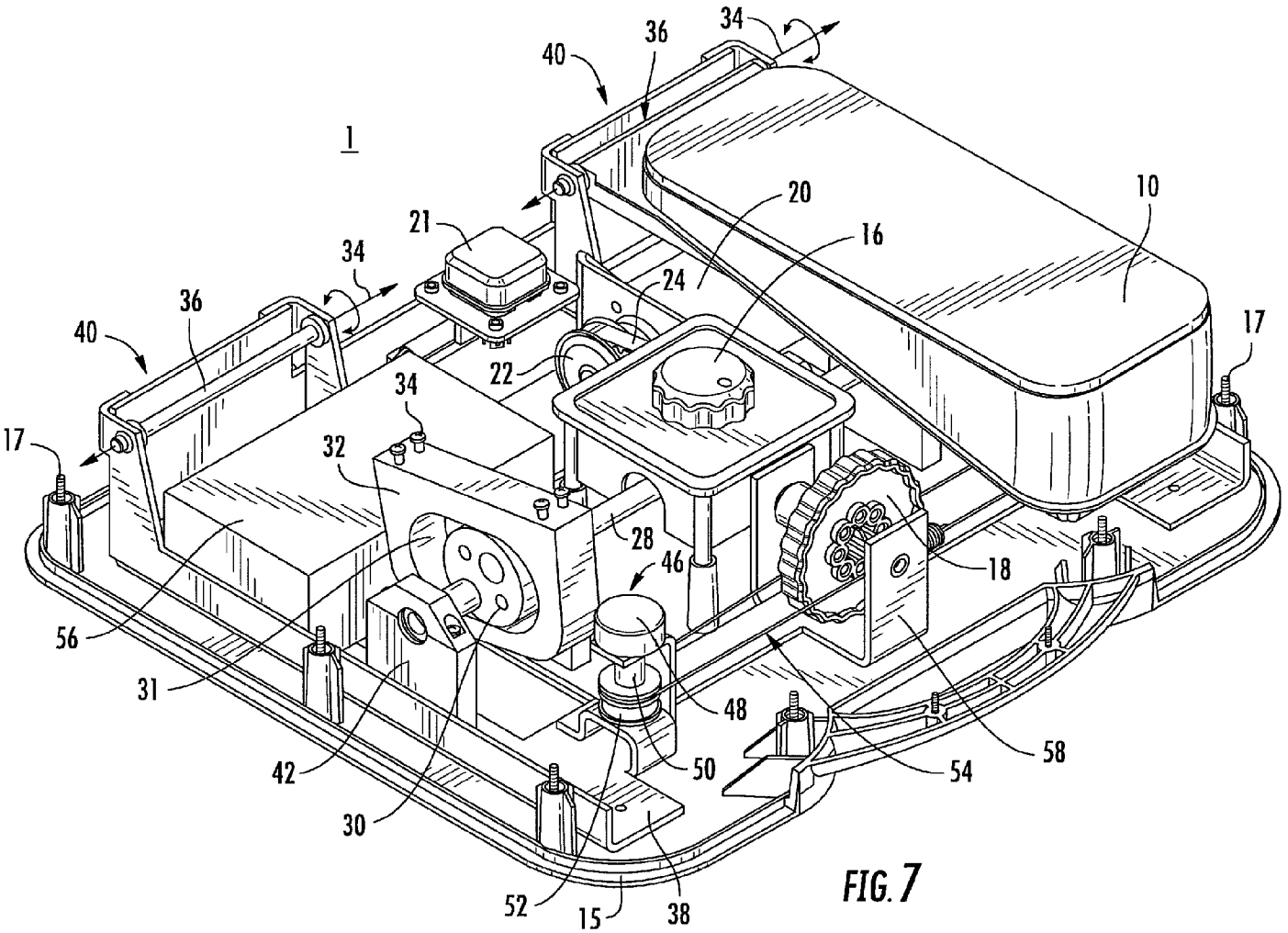
FIG. 7 is a perspective view of the apparatus of FIG. 1 with the top cover and one foot pedal removed.
Figure 8:
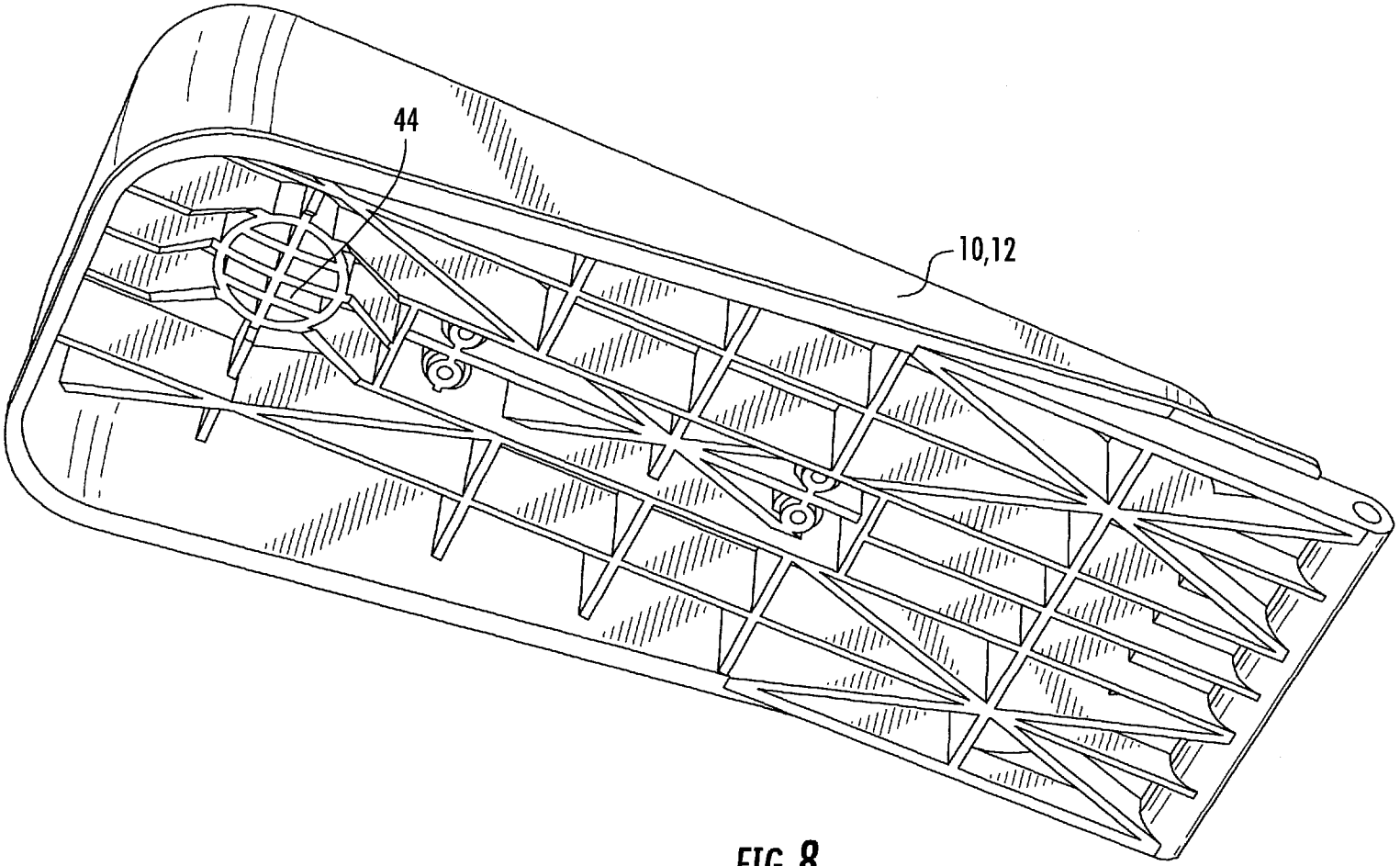
FIG. 8 is a perspective view of the underside of a foot pedal according to one embodiment of the present invention.

The interior workings of the exercise device 1 can be seen in the sectional views of FIGS. 3-6, as well as the perspective view of FIG. 7, which shows the interior without the housing top 14 and without right pedal 12. As shown in these figures, the interior of the device 1 includes mechanical and electrical elements that cooperate to cause the pedals to rockingly reciprocate, e.g., anti-phase to one another, between up and down positions, the pedals being rotatable, preferably at a rearward portion of each pedal, about a common axis.

The rocking motion for the movement of the pedals is provided in the first embodiment by a driving mechanism that includes a motor 20, the drive shaft of which drives a motor pulley 22. A stop/start button 21 is preferably provided to start the operation of the motor. The motor 20 is preferably a motor of a well-known type, such as a DC brushless motor, of a power sufficient to drive pedals of the apparatus. Power to the motor 20 is supplied, e.g., using power connector 23, or by disposable or rechargeable batteries, not shown.

The motor pulley 22 contacts a belt 24 which is also contacting a camshaft pulley 26. The belt transfers rotational motion of the motor pulley 22 to provide rotational motion to the camshaft pulley 26.

This rotation in turn causes a camshaft 28, arranged along an axis perpendicular to the camshaft pulley 26 and transverse to the feet, to rotate. A cam 30 is eccentrically coupled to each end of the camshaft 28. The eccentricity is provided, in the present embodiment, by the camshaft 28 coupling with the cam 30 in an off-center manner, that is, coupling to the cam 30 at a point on the cam 30 axially offset from the center of the cam 30. The off-center coupling causes eccentric rotating motion of each cam 30. While the cam 30 and the camshaft 28 are shown in the first embodiment as being distinct elements, the cam 30 can also be an integrally formed portion of each end of the camshaft 28.

To translate the rotational motion of the camshaft 28 to the up and down motion of the pedals, each cam 30 is arranged in a channel 31 provided in a pedal coupling member 32. The channel 31 is configured such that the eccentric motion of the cam 30 causes the coupling member 32 to reciprocate, such that a front end of the coupling member 32 moves up and down to a greater extent than the rear end of the coupling member 32.

The top of each coupling member 32 is affixed, for example, by screws 34, to the underside of the respective foot pedals 10 and 12. The cams 30 are arranged in the channel 31 of the respective pedal coupling members 32 such that the motion provided to the two pedal coupling members 32 by virtue of the eccentricity of the cams 30 at each end of the camshaft 28, generates alternating, i.e., anti-phase, reciprocating up and down motion of the pedals 10 and 12, so that, preferably, when one pedal is moving up, the other is moving down. However, in a variation of this configuration, the cams can be configured to provide in-phase movement of the pedals.

In the above-described manner, the motion of the camshaft 28, driven by the pulleys 22 and 26 and the motor 20, drives the pedals in an up and down motion about a common axis 34. The common axis 34 is preferably provided towards the rear of each pedal 10, 12 being rotatably mounted around a pedal axle 36, disposed along the common axis 34. While the disclosed embodiment shows the common axis disposed at an extreme end of each pedal, the invention is not limited to this configuration, and the device could be alternatively set up with the axis of rotation located away from an extreme end, while still providing the rocking motion.

The motor 20 is mounted on a mounting plate 38, to which various elements of the driving mechanism described above are also coupled, either directly or indirectly. The mounting plate 38 is located between the housing top 14 and the housing bottom 15 and acts as a chassis for mounting internal components of the exercise device 1.

The mounting plate 38 is preferably made of a lightweight metal, for example aluminum, steel, or the like. However any sufficiently strong and lightweight material can used, such as carbon reinforced plastic, or other similar material, that will result in a lightweight travel-friendly device. The mounting plate 38 includes two pedal mounting flanges 40 structured to secure each pedal axle 36 and the rear of each pedal 10, 12. Also coupled to the mounting plate 38 are bearing blocks 42, each of which receives and secures an end of the camshaft 28, or a tubular extension thereof, to allow rotation of the camshaft 28.

While the mechanism for converting the rotational motion of the reciprocating motion of the pedals is shown above using a pulley and belt system, as would be appreciated, the invention is not limited to this embodiment. Any manner of converting the rotational output of the motor to reciprocating motion of the pedals may be employed. As a non-limiting alternative, the output shaft of the motor 20 can be arranged perpendicular to the camshaft, and a bevel gear configuration used to drive the camshaft. Another variation would use a motor having output shafts along the rotational axis of the camshaft so as to directly drive the camshaft.

Optionally, the motor 20 can be adjustable to increase or decrease the speed of the movement of the pedals. In the speed-adjustable embodiment, a motor controller 56 is provided, which controls the speed of the motor 20 in accordance with the position of the speed adjustment knob 16. Such adjustment is well-known in the art and can be done in any conventional manner, for example by use of a potentiometer controlled by the knob 16, in which the motor speed is varied proportionally to a position of the knob 16, or electrical or digital equivalents thereof. In such configuration, the controller 56 is digitally or otherwise configured to receive information from the knob 16 and, based on this information, control the speed of the motor 20.

To provide beneficial tapping pulses to the user, each pedal 10, 12 is configured to contact a top portion of a bumper 46, at an inside contact surface 44 of each pedal, at the bottom of the downward toe stroke of each pedal provided by the reciprocating motion of the coupling members 32. Each bumper 46, one arranged under each pedal respectively, includes a bumper cover 48, for example made of rubber, and a bumper body 50, the lower part of which is a threaded cylindrical portion having threads 51.

The bumper body 50 is threadingly coupled to the mounting plate 38 such that rotation of the bumper body 50 effects an adjustment of its height with respect to the bumper body 50, as well as its proximity with respect to the contact surface 44 of the pedal 10, 12. In particular, to achieve adjustment of the height of the bumper 46, an annular screw jack 52 is configured such that inner threads 53 of each annular screw jack 52 mate with corresponding threads 51 of the cylindrical portion of the bumper body 50, so as to cause, upon a rotation of the annular screw jacks 52, a corresponding rotation of the bumper body 50, causing a change in the height of the bumper body relative to the mounting plate 38.

Each screw jack 52 having threads 53 is coupled to a tension cable 54 that wraps around the screw jack 52. The tension cable 54 is adjusted by the force adjustment control 18. The force adjustment control can be in the form of a knob, switch, lever or other user-selectable device. As an example, the control 18 is depicted in the figures as a knob. The force adjustment control knob 18 is coupled to the tension cable 54 so that adjustment of the knob 18 in a first direction bumpers 46, by twisting the screw jack 52 in one direction, e.g., clockwise, and adjustment of the control knob 18 in a second direction lowers bumpers 46, by twisting the screw jack 52 in an opposite direction, e.g., counter-clockwise. The knob 18 is preferably coupled to the mounting plate 38 at a dedicated rectangular portion 58 of the mounting plate 38, as can be seen in the figures.

The configuration of the bumper 46 and the control knob 18 allows for adjustment of the intensity of striking of the pedal 10, 12, in particular the contact surface 44, with the top of the bumper 46 by the turning of the control knob 18. The higher the position of the top of the bumpers 46, results in an increase of the pulsatile force applied to the bumpers 46. In a preferred embodiment the height of the bumper 46 is adjusted to allow for tapping that provides a range of pulsatile acceleration having a force sufficient to increase pulsatile shear stress to the endothelium, of sufficient magnitude to cause the release of beneficial mediators, such as nitric oxide, prostacyclin, tissue plasminogen activator, adrenomedullin, SIRT1, Brain and Glial Derived Neurotrophic Factors (BDNF & GDNF), Kruppel Like Factor 2, Superoxide Dismutase, Glutathione Peroxidase 1, Catalase, Total Antioxidant Capacity, Anti Apoptotic Proteins: p-Akt, Bcl2, and Bcl2/Bax, HSP27. Preferably, such effects can be provided with an acceleration of about 0.1 g to 0.5 g.

Such tapping to the feet provided by the apparatus can increase pulsatile shear stress as related to the addition of pulses into the vascular circulation, heart, lymphatic channels, interstitial spaces, skeletal muscle and bone interstices, as well as slight increases of cyclic strain to the blood vessels and lymphatic channels.

The tapping is also settable so as to increase the activity and content of endothelial nitric oxide synthase (eNOS) in blood vessels, heart and skeletal muscle, as well as to increase the activity of neuronal nitric oxide synthase (nNOS) in the heart and skeletal muscle. Moreover, using the apparatus repeatedly adds pulses and minimally increases cyclic strain, by the striking of the flat, padded, hard surface of the bumper 46 with the foot pedals, to the body's fluid filled channels over the body's own pulse such that even during periods when pulses are not imparted, bioavailability of the beneficial mediators is greater than the preoperational period.

Moreover, adding the pulses, using the striking of the bumper with the foot pedals, to the body's fluid filled channels over the body's own pulse stimulates endothelial release of at least one of nitric oxide, prostacyclin, tissue plasminogen activator (t-PA), adrenomedullin, endothelial dependent hyperpolarizing factor (EDHF), endothelial dependent relaxing factor, endothelial growth factors, and transcription factors, etc.

By using the apparatus in the manner described herein, the efficacy of treatment after a single or multiple sessions over a single duration of from about 10 to 30 minutes or more can be ascertained by sensing release of nitric oxide into the circulation by one or more of the following, a) descent of the dicrotic notch of the pulse waveform from any non-invasive or invasive technology that provides a raw arterial pulse waveform with the preferred embodiment a photoplethysmographic placed upon the finger and/or ear, b) fall in blood pressure measured by conventional means from baseline and during treatment upon termination of treatment that may last several minutes, c) a subjective, pleasant feeling of warmth and tingling over the skin of the lower extremities that may rise upwards toward the head.

The use of the apparatus also results in the suppression of inflammatory and pro-cancergenic factors such as nuclear factor kappa beta, endothelin-1, STAT3, and Pro-Apoptotic Proteins: Fas, TRAILR2, Bad, Caspase 3,8.

Figure 9:
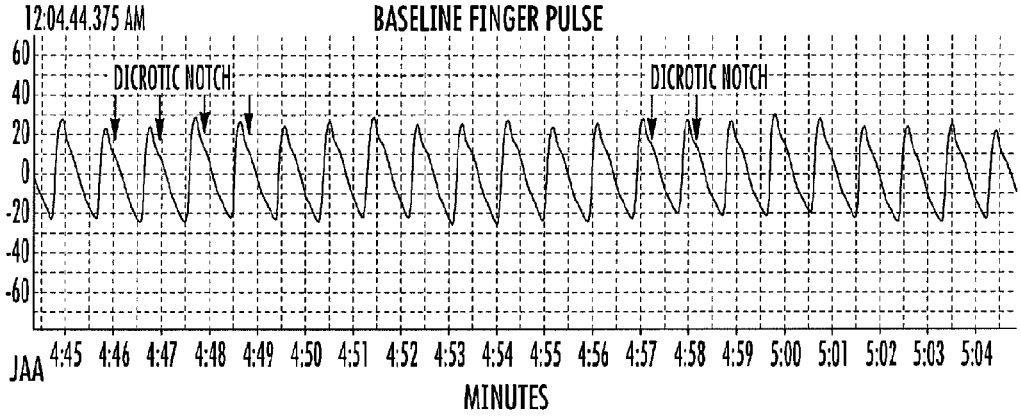
FIG. 9 includes diagrams showing the descent of the dicrotic notch as a reflection of Nitric Oxide release into circulation.
Figure 9:
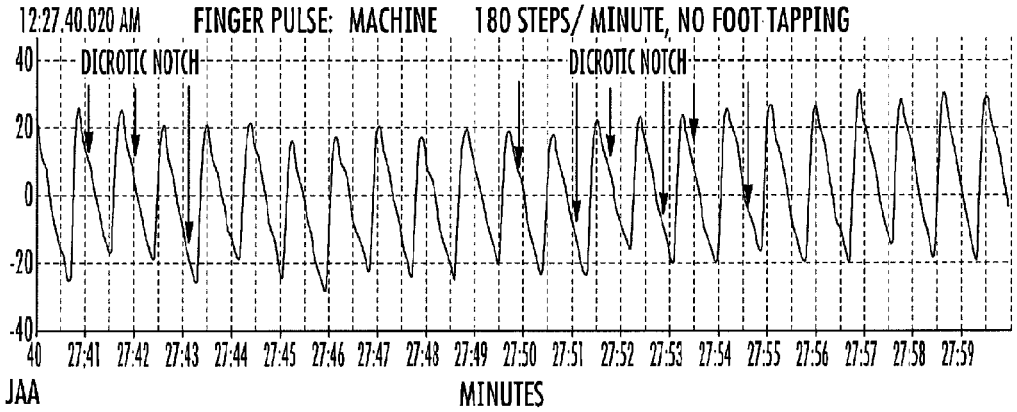
Figure 9:
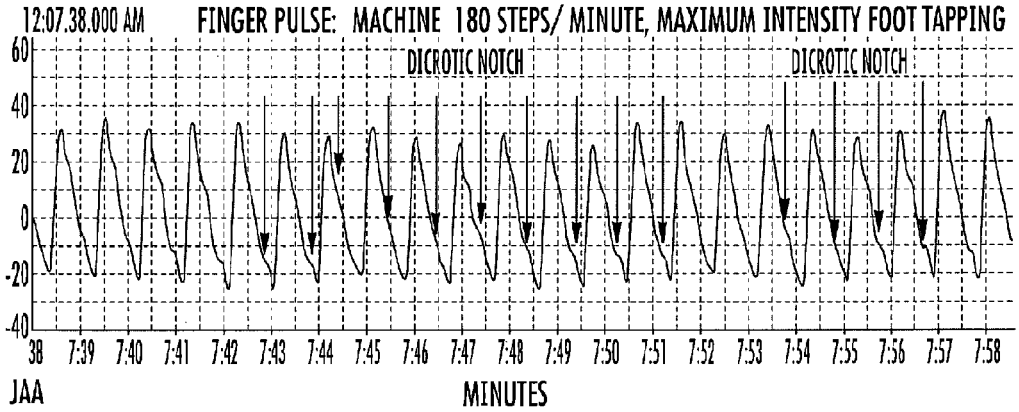

FIG. 9 shows the descent of dicrotic notch as a reflection of Nitric Oxice released into circulation using the apparatus in accordance with the present invention. The uppermost graph in the figure depicts the dicrotic notch from the raw photoplethsmographic sensor signal placed over the distal joint of the index finger. The dicrotic notch is high on the diastolic limb of the pulse wave in a normal position with almost no positional variability from beat to beat. The middle graph in the figure depicts the finger pulse during operation of the apparatus according to the present invention without foot tapping at 180 steps per minute. Here the dicrotic notch shows variability from beat to beat as it descends down the diastolic limb of the pulse wave (force is <0.2 g). Here, some pulses are in a similar position as the baseline pulse. The lowermost graph in the figure depicts the finger pulse during operation of the apparatus according to the present invention with foot tapping at 180 steps per minute. The dicrotic notch shows variability from beat to beat as it descends down the diastolic limb of the pulse wave (force ranges from 0.2 to 0.7 g and varies according to subject's weight and involuntary force applied by the subject). Here, the dicrotic notch of all pulses have a lower position on the diastolic limb of the pulse wave than baseline and the recordings made with no tapping. The lower the position of the dicrotic notch, the greater the nitric oxide release into the circulation thereby producing the greater effectiveness of the actions of this molecule in the body.

While the known addition of pulses using whole body periodic acceleration relied upon acceleration and deceleration of the blood's inertial properties, in the present invention it still plays a part but the foot tapping features provided by the apparatus produce more consistent descent of the dicrotic notch with greater pulsatile shear stress.

Figure 10:
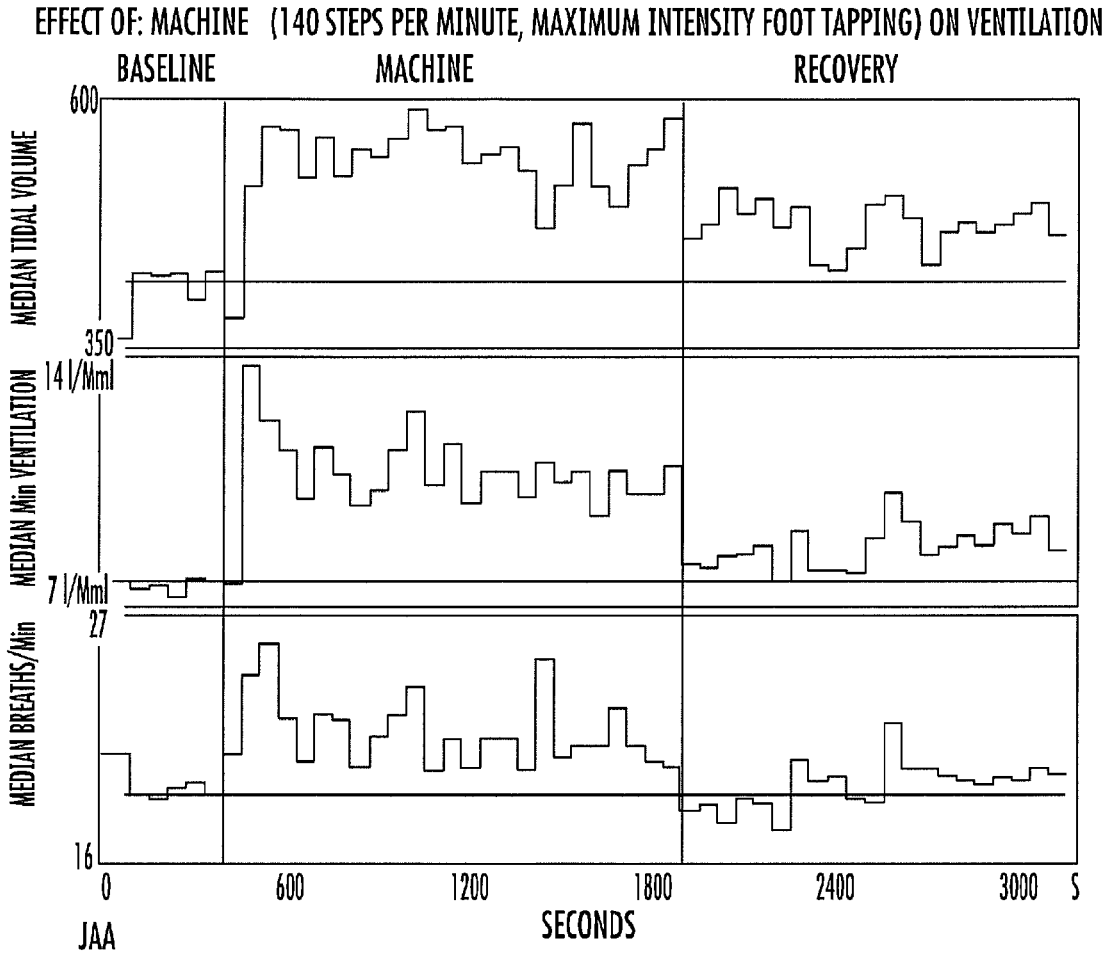
FIG. 10 is a diagram showing the effect of the apparatus according the present invention.

As shown in FIG. 10, minute ventilation was measured in three seated, normal subjects during application of pulses in accordance with the apparatus of the present invention at 140 steps per minute with maximum foot tapping during a 25 minute period. Non-invasive respiratory inductive plethysmography was utilized for the measurements. Minute ventilation increased approximately 3 liters over baseline as a result of increases in both tidal volume and respiratory rate. This increase was similar to that found in three supine, normal subjects during 20 minutes of WBPA applied in the supine posture. In this study, measurements were made with a pneumotachograph and mouthpiece assembly. The Force ranged from 0.2 to 0.7 g.

The increase in ventilation associated with passive movements of the feet and tapping presumably was due to stimulation of mechanoreceptor in the legs that stimulated the respiratory center as a reflex. This also occurs during passive bicycle exercise. Oxygen consumption measured in paraplegic and quadriplegic patients during passive cycling, where there can be no active muscular efforts, increases from 30 to 40 ml above baseline. This is comparable to the amount previously observed in normal subjects during application of WBPA for 30 minutes. Therefore, since the increase in minute ventilation between WBPA and foot lifting and tapping are the same, one would expect a similar increase of oxygen consumption. Thus would fall into the category of NEAT and if carried out at least two to three hours daily with dietary intake constant over weeks or months would lead to loss of body weight, Upon stopping the device after its operation of five minutes or more in most subjects, a pleasant tingling sensation of the skin over the lower extremities extending up the trunk occurs that lasts seconds to minutes. This is often accompanied by a fall in mean blood pressure of 5 to 10 mm Hg. It may be analogous to post-exercise hypotension after exercise that is thought to be related to an increase of nitric oxide release.

Figure 11:
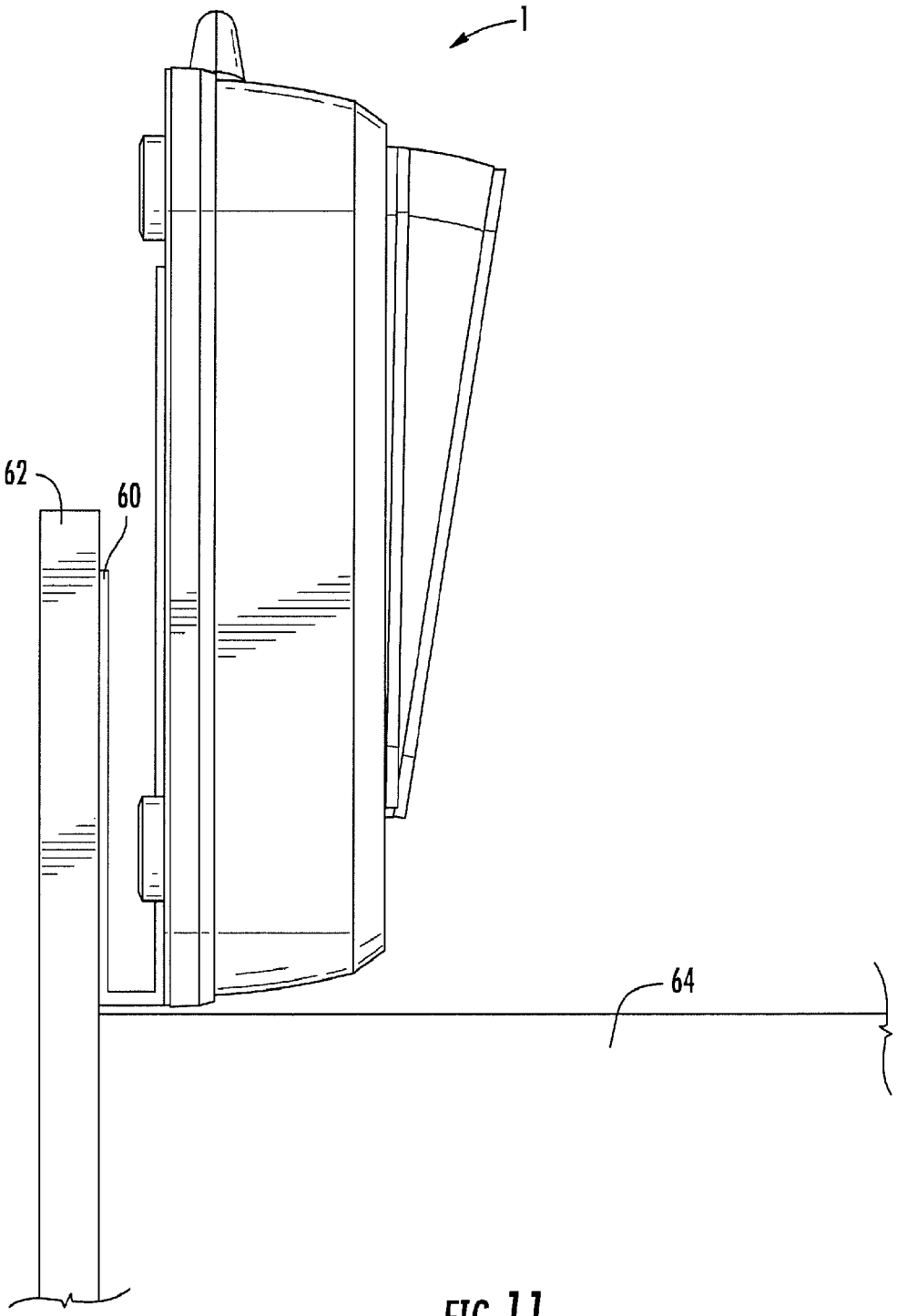
FIG. 11 is a diagram showing the apparatus of FIG. 1 with a bracket provided for vertical mounting.
Figure 12:
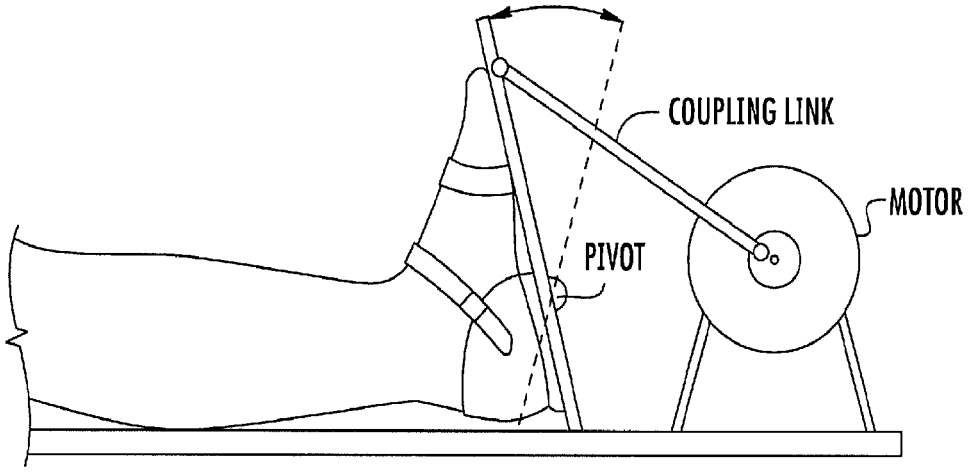
FIG. 12 (PRIOR ART)
FIG. 12 is a diagram of a prior art exercise machine.

FIG. 11 shows application of the apparatus 1 in a vertical orientation, so that a user can use it while lying on a bed. For such purpose the apparatus can be fitted with, or have, a bracket 60 extending from the bottom thereof, in this case extending leftward in the figure with respect to the apparatus 1. The bracket 60 is configured to securely and adjustably mount to a vertically oriented support member 62, for example a headboard portion of a bed 64. The same benefits as described above are provided with the apparatus in this position.

Although example embodiments have been shown and described in this specification and figures, it will be appreciated by those skilled in the art that changes may be made to the illustrated and/or described example embodiments without departing from their principles and spirit.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A motorized machine for passively applying a tapping force to the bottoms of a user's feet, the machine comprising:

a housing;

an axis-defining mechanism coupled to the housing, the axis-defining mechanism configured to define a rocking axis;

at least one pedal positioned to receive a foot of the user and mounted on the rocking axis for rocking movement of the at least one pedal;

a motor arranged within the housing, the motor configured to generate rotational motion to an output shaft of the motor;

a pedal rocking mechanism coupled to the output shaft and driven by the motor, the pedal rocking mechanism being configured to translate the rotational motion generated by the motor to reciprocating rocking motion of the at least one pedal about the rocking axis; and at least one bumper, height-adjustably coupled to the housing, located spaced apart from a bottom portion of the at least one pedal, the reciprocating rocking motion of the at least one pedal provided by the pedal rocking mechanism providing a positive application of force for moving the bottom portion of the pedal towards and away from the at least one bumper, wherein the motor, the pedal rocking mechanism, the at least one pedal and the at least one bumper are configured so as to cooperate to apply, by the pedal rocking mechanism, the positive application of force to the at least one pedal so as to, during operation of the motor, cause the bottom portion of the at least one pedal to tap against the at least one bumper so as to provide pulsatile acceleration to the bottom of the user's foot, said pulsatile acceleration having a force sufficient to increase pulsatile shear stress to the endothelium, of sufficient magnitude to cause the release of beneficial mediators.

2. The motorized machine of claim 1, wherein the at least one pedal comprises two pedals, one for each foot of the user and the at least one bumper comprises two bumpers, one for each of the two pedals.

3. The motorized machine of claim 2, wherein the rocking of one of the two pedals is anti-phase with the rocking of the other of the two pedals.

4. The motorized machine of claim 2, wherein the rocking of one of the two pedals is in-phase with the rocking of the other of the two pedals.

5. The motorized machine of claim 2, wherein the pedal rocking mechanism has:

a camshaft coupled to the output shaft of the motor;

two cams, each cam eccentrically coupled to an end of the camshaft; and two pedal coupling mechanisms, each corresponding to one of the two pedals, each pedal coupling mechanism configured to contact one of the two cams, the cam cooperating with the pedal coupling mechanism to convert rotational motion of the cam to reciprocating motion of the pedal coupling mechanism so as cause the rocking motion of the pedals.

6. The motorized machine of claim 5, wherein the camshaft is coupled to the output shaft of the motor by a pulley and belt mechanism.

7. The motorized machine of claim 5, wherein the camshaft is coupled to the output shaft of the motor by a gear mechanism.

8. The motorized machine of claim 2, wherein the height adjustment of the two bumpers provides a tapping force to the bumper of approximately 0.1 to 0.5 g.

9. A method of treatment using the motorized machine according to claim 2, comprising:

repeatedly adding pulses and minimally increasing cyclic strain, using the striking of the bumper with the foot pedals, to the body's fluid filled channels over the body's own pulse such that even during periods when pulses are not imparted, bioavailability of the beneficial mediators is greater than the preoperational period.

10. A method of treatment using the motorized machine according to claim 2, comprising:

adding pulses, using the striking of the bumper with the foot pedals, to the body's fluid filled channels over the body's own pulse sufficient to stimulate endothelial release of at least one of nitric oxide, prostacyclin, tissue plasminogen activator (t-PA), adrenomedullin, endothelial dependent hyperpolarizing factor (EDHF), endothelial dependent relaxing factor, endothelial growth factors, and transcription factors.

11. A method of treatment using the motorized machine according to claim 2, comprising:

adding pulses, using the striking of the bumper with the foot pedals, to the body's fluid filled channels over the body's own pulse sufficient to increase the activity and content of endothelial nitric oxide synthase (eNOS) in blood vessels, heart and skeletal muscle, as well as to increase the activity of neuronal nitric oxide synthase (nNOS) in the heart and skeletal muscle.

12. The method of claim 11, wherein release of nitric oxide from eNOS stimulated by pulsatile shear stress brought about by the added pulses increases release of endothelial progenitor and CD34 cells into the circulation from bone marrow that serve a reparative role in damaged vascular endothelium as occurs in arteriosclerosis.

13. The method of claim 11, wherein activation of neuronal nitric oxide synthesis (nNOS) stimulated by pulsatile shear stress brought about by the added pulses increases vagal nerve tone as measured by heart rate.

14. The motorized machine according to claim 2, wherein the foot pedals, when driven in rocking motion by the motor, are configured to passively move the feet in a reciprocal sinusoidal up and down motion with one end of the foot pedals actively rising and falling approximately 1.25" with the other end serving as a pivot point around the rocking axis, and the two foot pedals are set approximately 12" apart on the horizontal plane.

15. The motorized machine according to claim 1, wherein the beneficial mediators include at least one from the group consisting of:

nitric oxide, prostacyclin,
tissue plasminogen activator,
adrenomedullin,
SIRT1,
Brain and Glial Derived Neurotrophic Factors (BDNF & GDNF),
Kruppel Like Factor 2,
Superoxide Dismutase, Glutathione Peroxidase 1, Catalase, Total Antioxidant Capacity, and
Anti Apoptotic Proteins: p-Akt, Bcl2, and Bcl2/Bax, HSP27.

16. The motorized machine of according to claim 1, wherein the pulsatile acceleration to the user having a force sufficient to increase pulsatile shear stress to the endothelium is of sufficient magnitude to suppress inflammatory and pro-cancergenic factors, including at least one from the group consisting of:
nuclear factor kappa beta,
endothelin-1,
STAT3, and
Pro-Apoptotic Proteins: Fas, TRAILR2, Bad, Caspase 3,8.

17. The motorized machine according to claim 1, wherein the tapping provides pulsatile acceleration to the user having a force sufficient to increase pulsatile shear stress as related to the addition of pulses into the vascular circulation, heart, lymphatic channels, interstitial spaces, skeletal muscle and bone interstices, as well as slight increases of cyclic strain to the blood vessels and lymphatic channels.

18. The motorized machine according to claim 1, wherein the tapping provides pulsatile acceleration to the user having a force sufficient to increase the activity and content of endothelial nitric oxide synthase (eNOS) in blood vessels, heart and skeletal muscle, as well as to increase the activity of neuronal nitric oxide synthase (nNOS) in the heart and skeletal muscle.

19. A method of measuring the efficacy of treatment using the motorized machine of claim 1 after a single or multiple sessions over a single duration of from about 10 to 30 minutes or more, the method comprising sensing release of nitric oxide into the circulation by one or more of the following:
a) descent of the dicrotic notch of the pulse waveform that provides a raw arterial pulse waveform with a photoplethysmographic sensor placed upon the finger and/or ear, and/or
b) fall in blood pressure lasting several minutes after treatment, the blood pressure being measured from baseline and during treatment upon termination of treatment.

20. The motorized machine according to claim 1, wherein the motor is a DC brushless motor.

21. The motorized machine according to claim 1, wherein the machine further comprises an input for supplying power to the motor.

22. The motorized machine according to claim 1, further comprising a mounting bracket, arranged at the bottom of the machine, to facilitate mounting of the machine on a vertical support, so as to permit use of the machine by a user lying in a bed.

* * * * *